US010127885B2

(12) United States Patent
Mitsui

(10) Patent No.: US 10,127,885 B2
(45) Date of Patent: Nov. 13, 2018

(54) DISPLAY DEVICE, METHOD FOR DRIVING THE SAME, AND ELECTRONIC APPARATUS

(71) Applicant: Japan Display Inc., Tokyo (JP)

(72) Inventor: Masashi Mitsui, Tokyo (JP)

(73) Assignee: Japan Display Inc., Tokyo (JP)

( * ) Notice: Subject to any disclaimer, the term of this patent is extended or adjusted under 35 U.S.C. 154(b) by 361 days.

(21) Appl. No.: 14/723,667

(22) Filed: May 28, 2015

(65) Prior Publication Data

US 2015/0348501 A1 Dec. 3, 2015

(30) Foreign Application Priority Data

May 30, 2014 (JP) ..... 2014-113445

(51) Int. Cl.

| | |
|---|---|
| ***G09G 5/02*** | (2006.01) |
| ***G09G 3/34*** | (2006.01) |
| ***G09G 3/36*** | (2006.01) |

(52) U.S. Cl.

CPC ..... *G09G 5/02* (2013.01); *G09G 3/3406* (2013.01); *G09G 3/3648* (2013.01); *G09G 2300/0452* (2013.01); *G09G 2340/06* (2013.01); *G09G 2360/144* (2013.01); *G09G 2360/16* (2013.01); *G09G 2380/10* (2013.01)

(58) Field of Classification Search

None

See application file for complete search history.

(56) References Cited

U.S. PATENT DOCUMENTS

| | | | | |
|---|---|---|---|---|
| 8,830,277 | B2 | 9/2014 | Higashi et al. | |
| 2007/0091213 | A1* | 4/2007 | Jaspers | H04N 9/68 348/687 |
| 2009/0003695 | A1* | 1/2009 | Chiang | H04N 5/18 382/167 |
| 2009/0315921 | A1 | 12/2009 | Sakaigawa et al. | |
| 2010/0214245 | A1* | 8/2010 | Hirota | G02F 1/13338 345/173 |
| 2011/0128438 | A1* | 6/2011 | Yamashita | G06T 1/00 348/384.1 |
| 2011/0157252 | A1* | 6/2011 | Yamazaki | G02F 1/133555 345/690 |
| 2013/0027441 | A1* | 1/2013 | Kabe | G09G 3/3413 345/690 |
| 2014/0347410 | A1 | 11/2014 | Higashi et al. | |

FOREIGN PATENT DOCUMENTS

| | | |
|---|---|---|
| JP | 2010-033009 | 2/2010 |
| JP | 2012-022217 | 2/2012 |

* cited by examiner

*Primary Examiner* — Christopher Kohlman
(74) *Attorney, Agent, or Firm* — K&L Gates LLP

(57) ABSTRACT

According to an aspect, a display device includes an image display panel in which pixels are arranged; and a signal processing unit that converts input values of input signals including color information of a certain color represented in a reference color gamut into extended values in an extended color space to generate output signals. The signal processing unit corrects the input values of the input signals into input values of corrected input signals including color information of a corrected color so as to correct the certain color into the corrected color that is a color positioned in a direction away from a white point, determines an expansion coefficient, and obtains the output signals for first to fourth sub-pixels based on at least the corrected input signals and the expansion coefficient.

7 Claims, 16 Drawing Sheets

DISPLAY DEVICE, METHOD FOR DRIVING THE SAME, AND ELECTRONIC APPARATUS

CROSS REFERENCES TO RELATED APPLICATIONS

The present application claims priority to Japanese Priority Patent Application JP 2014-113445 filed in the Japan Patent Office on May 30, 2014, the entire content of which is hereby incorporated by reference.

BACKGROUND

1. Technical Field

The present disclosure relates to a display device, a method for driving the display drive, and an electronic apparatus including the display device.

2. Description of the Related Art

For a display device such as a liquid crystal display device, a technique has been developed by which a white pixel serving as a fourth sub-pixel is added to conventional red, green, and blue sub-pixels serving as first to third sub-pixels, as disclosed in Japanese Patent Application Laid-open Publication No. 2012-22217. With this technique, the white sub-pixel increases luminance, thereby causing images to be brightly displayed and improving visibility of the display device.

Display devices such as liquid crystal display devices include transmissive display devices and reflective display devices. Transmissive display devices display images with light transmitted through a liquid crystal panel by emitting the light from a backlight provided on the back side of the liquid crystal panel. Reflective display devices display images with reflected light obtained by reflecting light emitted from the front of a liquid crystal panel toward the liquid crystal panel. The above-described technique of adding the white sub-pixel can be applied to both transmissive display devices and reflective display devices.

When the white sub-pixel is joined with the red, green, and blue sub-pixels, the white sub-pixel can reduce contrast of colors represented by the red, green, and blue sub-pixels. The reduction in contrast of colors may deteriorate images displayed on display devices.

For the foregoing reasons, there is a need for a display device, a method for driving the same, and an electronic apparatus that can reduce deterioration of images.

SUMMARY

According to an aspect, a display device includes: an image display panel in which pixels are arranged in a two-dimensional matrix, each of the pixels including a first sub-pixel that displays a first color, a second sub-pixel that displays a second color, a third sub-pixel that displays a third color, and a fourth sub-pixel that displays a fourth color; and a signal processing unit that converts input values of input signals including color information of a certain color represented in a reference color gamut into extended values in a color space extended with the first color, the second color, the third color, and the fourth color to generate output signals, and outputs the generated output signals to the image display panel. The signal processing unit corrects the input values of the input signals into input values of corrected input signals including color information of a corrected color so as to correct the certain color into the corrected color that is a color positioned in a direction away from a white point that is a place where white is represented in the reference color gamut or a display color gamut that is a color gamut of colors displayable by the image display panel, determines an expansion coefficient related to the image display panel, obtains an output signal for the first sub-pixel based on at least a corrected input signal of the first sub-pixel and the expansion coefficient, and outputs the obtained output signal to the first sub-pixel, obtains an output signal for the second sub-pixel based on at least a corrected input signal of the second sub-pixel and the expansion coefficient, and outputs the obtained output signal to the second sub-pixel, obtains an output signal for the third sub-pixel based on at least a corrected input signal of the third sub-pixel and the expansion coefficient, and outputs the obtained output signal to the third sub-pixel, and obtains an output signal for the fourth sub-pixel based on the corrected input signal of the first sub-pixel, the corrected input signal of the second sub-pixel, the corrected input signal of the third sub-pixel, and the expansion coefficient, and outputs the obtained output signal to the fourth sub-pixel.

According to another aspect, a method for driving a display device, the display device including an image display panel including a plurality of pixels each including a first sub-pixel that displays a first color, a second sub-pixel that displays a second color, a third sub-pixel that displays a third color, and a fourth sub-pixel that displays a fourth color, the method including: obtaining an output signal for each of the first sub-pixel, the second sub-pixel, the third sub-pixel, and the fourth sub-pixel based on input values of input signals including color information of a certain color represented in a reference color gamut; and controlling an operation of each of the first sub-pixel, the second sub-pixel, the third sub-pixel, and the fourth sub-pixel based on the output signal. The obtaining of the output signal includes: correcting the input values of the input signals into input values of corrected input signals including color information of a corrected color so as to correct the certain color into the corrected color that is a color positioned in a direction away from a white point that is a place where white is represented in the reference color gamut, determining an expansion coefficient related to the image display panel, obtaining the output signal for the first sub-pixel based on at least a corrected input signal of the first sub-pixel and the expansion coefficient, obtaining the output signal for the second sub-pixel based on at least a corrected input signal of the second sub-pixel and the expansion coefficient, obtaining the output signal for the third sub-pixel based on at least a corrected input signal of the third sub-pixel and the expansion coefficient, and obtaining the output signal for the fourth sub-pixel based on the corrected input signal of the first sub-pixel, the corrected input signal of the second sub-pixel, the corrected input signal of the third sub-pixel, and the expansion coefficient.

Additional features and advantages are described herein, and will be apparent from the following Detailed Description and the figures.

DETAILED DESCRIPTION

Figure 1:
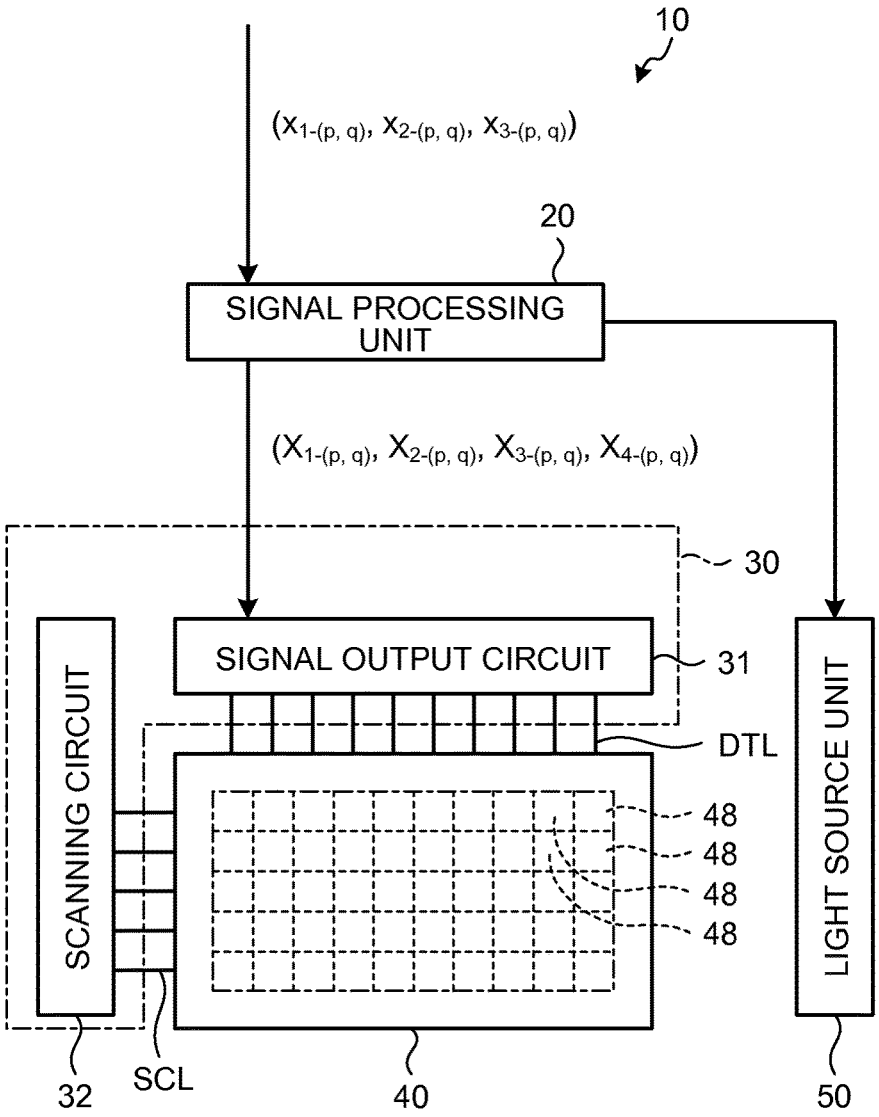
FIG. 1 is a block diagram illustrating an example of the configuration of a display device according to a first embodiment.

The following describes embodiments of the present disclosure in detail in the following order with reference to the drawings.

1. First Embodiment
2. Modification
3. Second Embodiment
4. Third Embodiment
5. Application Examples 1. First Embodiment The following describes the embodiments of the present invention with reference to the drawings. The disclosure is merely an example, and the present invention naturally encompasses an appropriate modification maintaining the gist of the invention that is easily conceivable by those skilled in the art. To further clarify the description, a width, a thickness, a shape, and the like of each component may be schematically illustrated in the drawings as compared with an actual aspect. However, this is merely an example and interpretation of the invention is not limited thereto. The same element as that described in the drawing that has already been discussed is denoted by the same reference numeral through the description and the drawings, and detailed description thereof will be omitted as appropriate in some cases.

Configuration of Display Device

Figure 2:
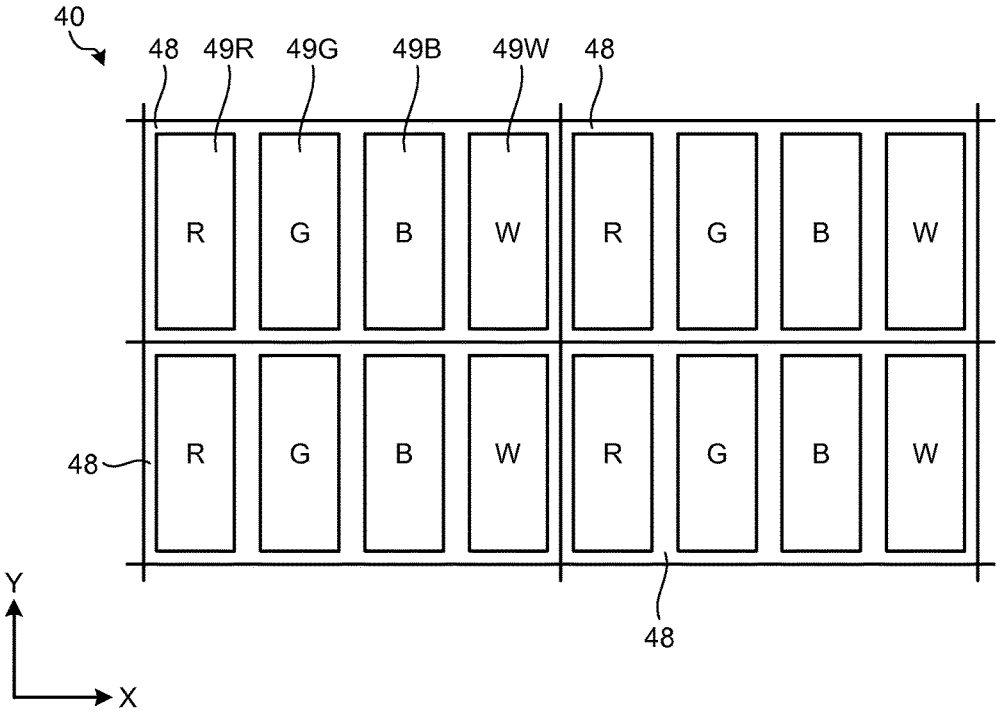
FIG. 2 is a conceptual diagram of an image display panel according to the first embodiment.
Figure 3:
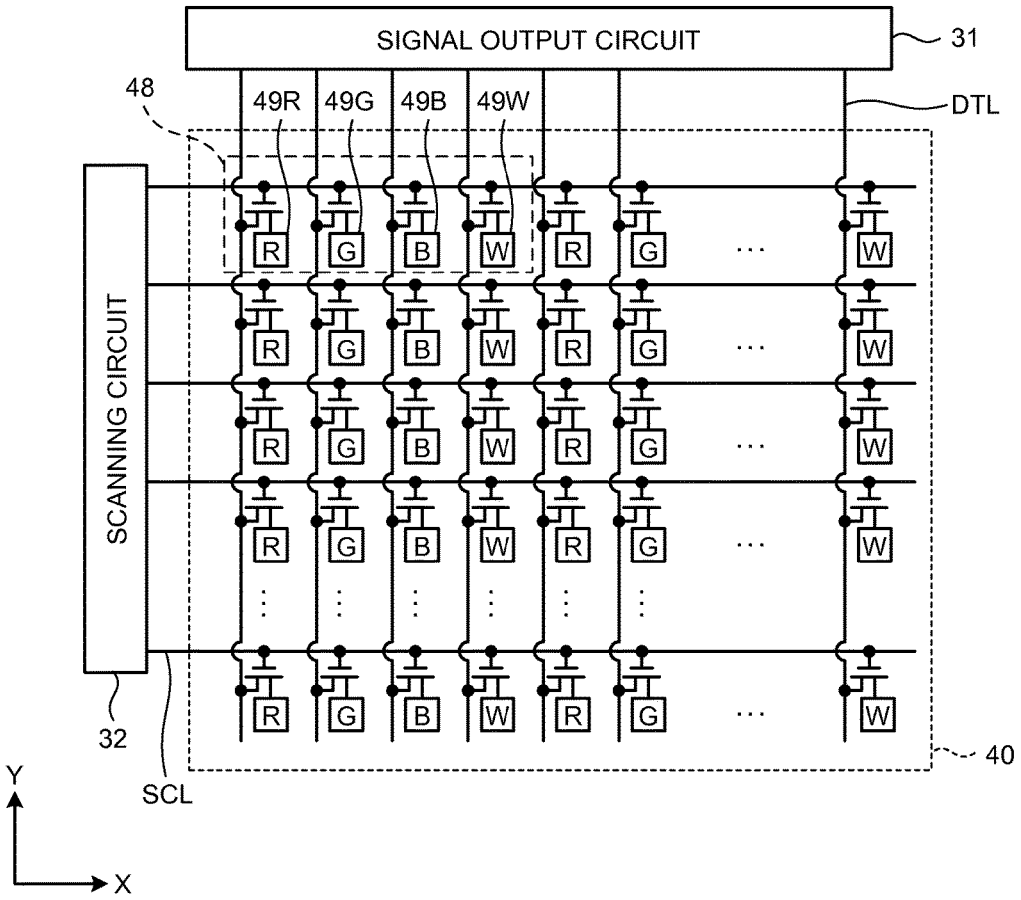
FIG. 3 is a conceptual diagram of the image display panel and an image-display-panel driving unit of the display device according to the first embodiment.

FIG. 1 is a block diagram illustrating an example of the configuration of a display device according to a first embodiment. FIG. 2 is a conceptual diagram of an image display panel according to the first embodiment. FIG. 3 is a conceptual diagram of the image display panel and an image-display-panel driving unit of the display device according to the first embodiment. As illustrated in FIG. 1, a display device 10 of the first embodiment includes a signal processing unit 20, an image-display-panel driving unit 30, an image display panel 40, and a light source unit 50. In the display device 10, the signal processing unit 20 sends signals to components of the display device 10; the image-display-panel driving unit 30 controls driving of the image display panel 40 based on signals received from the signal processing unit 20; and the image display panel 40 causes an image to be displayed based on the signals received from the image-display-panel driving unit 30. The display device 10 displays the image by reflecting external light on the image display panel 40. In cases such as when being used at night in an outdoor place with insufficient external light or used in a dark place, the display device 10 can display the image by reflecting light emitted from the light source unit 50 on the image display panel 40.

As illustrated in FIGS. 1 and 2, in the image display panel 40, pixels 48 are arranged in a two-dimensional matrix of $P_0 \times Q_0$ pixels ($P_0$ in the row direction, and $Q_0$ in the column direction). FIGS. 2 and 3 illustrate an example in which the pixels 48 are arranged in a matrix in a two-dimensional XY coordinate system. In this example, the row direction as a first direction corresponds to the X-axis direction, and the column direction as a second direction corresponds to the Y-axis direction. The row direction may correspond to the Y-axis direction, and the column direction may correspond to the X-axis direction.

Each of the pixels 48 includes a first sub-pixel 49R, a second sub-pixel 49G, and either a third sub-pixel 49B or a fourth sub-pixel 49W. The first sub-pixel 49R displays a first primary color (for example, red). The second sub-pixel 49G displays a second primary color (for example, green). The third sub-pixel 49B displays a third primary color (for example, blue). The fourth sub-pixel 49W displays a fourth color (white in the first embodiment). In this way, each of the pixels 48 arranged in a matrix in the image display panel 40 includes the first sub-pixel 49R that displays a first color, the second sub-pixel 49G that displays a second color, the third sub-pixel 49B that displays a third color, and the fourth sub-pixel 49W that displays the fourth color. The first color, the second color, the third color, and the fourth color are not limited to the first primary color, the second primary color, the third primary color, and white, but only need to be different colors from one another, such as complementary colors. The fourth sub-pixel 49W that displays the fourth color is preferably brighter than the first sub-pixel 49R that displays the first color, the second sub-pixel 49G that displays the second color, and the third sub-pixel 49B that displays the third color when irradiated with the same lighting quantity of a light source. In the following description, the first sub-pixel 49R, the second sub-pixel 49G, the third sub-pixel 49B, and the fourth sub-pixel 49W will be called a sub-pixel 49 when they need not be distinguished from one another.

The display device 10 is more specifically a reflective color liquid crystal display device. The image display panel 40 is a color liquid crystal display panel. The first sub-pixel 49R is provided with a first color filter, through which light is transmitted toward an image observer to be displayed as the first primary color. The second sub-pixel 49G is provided with a second color filter, through which light is transmitted toward the image observer to be displayed as the second primary color. The third sub-pixel 49B is provided with a third color filter, through which light is transmitted toward the image observer to be displayed as the third primary color. The image display panel 40 has no color filter between the fourth sub-pixel 49W and the image observer. A transparent resin layer may be provided for the fourth sub-pixel 49W instead of the color filter. The image display panel 40 thus provided with the transparent resin layer can suppress the occurrence of a large gap above the fourth sub-pixel 49W, otherwise a large gap occurs because no color filter is arranged for the fourth sub-pixel 49W has no color filter.

Figure 4:
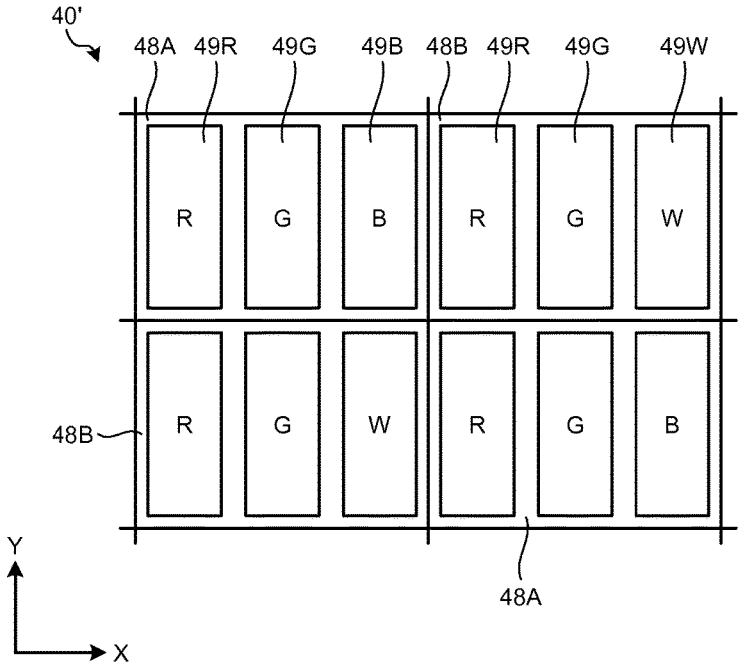
FIG. 4 is a diagram illustrating another example of a pixel array of the image display panel according to the first embodiment.

In the example illustrated in FIG. 2, the first, the second, the third, and the fourth sub-pixels 49R, 49G, 49B, and 49W in the image display panel 40 are arranged in an array similar to a stripe array. The structure and arrangement of the sub-pixels 49R, 49G, 49B, and 49W included in each of the pixels 48 are not limited. For example, the first, the second, the third, and the fourth sub-pixels 49R, 49G, 49B, and 49W in the image display panel 40 may be arranged in an array similar to a diagonal array (mosaic array). The sub-pixels may also be arranged, for example, in an array similar to a delta array (triangular array), or a rectangular array. FIG. 4 is a diagram illustrating another example of the pixel array of the image display panel according to the first embodiment. As illustrated in an image display panel 40' in FIG. 4, pixels 48A each including the first, the second, and the third sub-pixels 49R, 49G, and 49B and pixels 48B each including the first and the second sub-pixels 49R and 49G and the fourth sub-pixel 49W may be alternately arranged in the row direction and the column direction.

In general, an array similar to a stripe array is preferred to display data or character strings on a personal computer or the like. In contrast, an array similar to a mosaic array is preferred to display a natural image on a video camera recorder, a digital still camera, or the like.

As illustrated in FIG. 1, the signal processing unit 20 is an arithmetic processing circuit that controls operations of the image display panel 40 via the image-display-panel driving unit 30. The signal processing unit 20 is coupled to the image-display-panel driving unit 30 and the light source unit 50.

The signal processing unit 20 processes input signals received from an external application processor (a host CPU, not illustrated) to generate output signals. The signal processing unit 20 converts input values of the input signals into extended values (output signals) in an extended color space (an extended HSV color space in the first embodiment) to be extended with the first color, the second color, the third color, and the fourth color. The signal processing unit 20 then outputs the generated output signals to the image-display-panel driving unit 30.

The input signals are RGB data including color information that represents a certain color represented in a reference color gamut. In the first embodiment, the reference color gamut is a color gamut of the sRGB standard. Various standards applicable to image display can, however, be used for the reference color gamut. The reference color gamut may be, for example, a color gamut according to the Adobe (registered trademark) RGB standard or a color gamut according to the NTSC standard. The sRGB standard is a standard defined by the International Electrotechnical Commission (IEC). The Adobe (registered trademark) RGB standard is a standard defined by Adobe Systems Incorporated. The NTSC standard is a standard defined by the National Television System Committee. In the first embodiment, the extended color space is an HSV (Hue-Saturation-Value, Value is also called Brightness) color space, but not limited to this, and may be an XYZ color space, a YUV space, or any other coordinate system.

Figure 5:
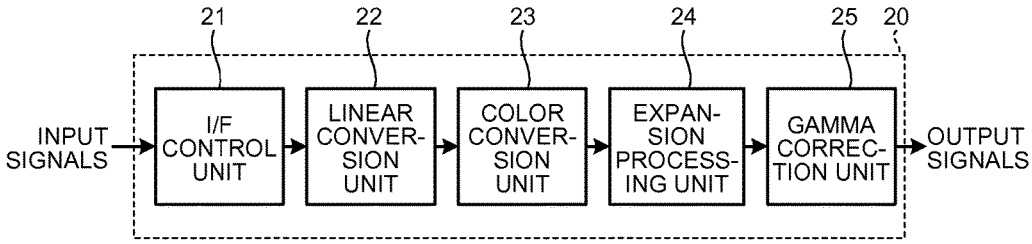
FIG. 5 is a block diagram illustrating the configuration of a signal processing unit according to the first embodiment.

FIG. 5 is a block diagram illustrating the configuration of the signal processing unit according to the first embodiment. As illustrated in FIG. 5, the signal processing unit 20 according to the first embodiment includes an I/F control unit 21, a linear conversion unit 22, a color conversion unit 23, an expansion processing unit 24, and a gamma correction unit 25.

The I/F control unit 21 is an interface that receives from the outside the input signals serving as information (RGB data) of an image. Specifically, the I/F control unit 21 converts the certain input signals received from the outside into a data format suitable for data processing in the linear conversion unit 22, the color conversion unit 23, the expansion processing unit 24, and the gamma correction unit 25, and outputs the results to the linear conversion unit 22.

The linear conversion unit 22 applies a linear conversion serving as an inverse gamma correction to the input signals received via the I/F control unit 21. Specifically, the linear conversion unit 22 converts (inversely gamma-corrects) the input signals having been gamma-corrected with a gamma value (such as a gamma of 2.2) larger than 1 into RGB data having a gamma value of 1. For example, if the input signals are RGB data represented by 8 bits (0 to 255), the linear conversion unit 22 normalizes each of the values of a red (R) component, a green (G) component, and a blue (B) component of the RGB data into a value of 0 to 1, and outputs the normalized RGB data to the color conversion unit 23. The RGB data need not be normalized as described above, but may be output to the color conversion unit 23 as it is inversely gamma-corrected.

The color conversion unit 23 applies color conversion processing to the normalized input signals received from the linear conversion unit 22, and outputs the corrected input signals after being color-converted to the expansion processing unit 24. The following describes calculation of corrected input signals for input signals ($x_{1-(p,q)}$, $x_{2-(p,q)}$, and $x_{3-(p,q)}$) to a (p,q)-th pixel 48 (where $1 \le p \le P_0$ and $1 \le q \le Q_0$). The input signals ($x_{1-(p,q)}$, $x_{2-(p,q)}$, and $x_{3-(p,q)}$) include an input signal of the first sub-pixel 49R having a signal value of $x_{1-(p,q)}$, an input signal of the second sub-pixel 49G having a signal value of $x_{2-(p,q)}$, and an input signal of the third sub-pixel 49B having a signal value of $x_{3-(p,q)}$. The color conversion unit 23 generates, from the input signals ($x_{1-(p,q)}$, $x_{2-(p,q)}$, and $x_{3-(p,q)}$), corrected input signals ($xa_{1-(p,q)}$, $xa_{2-(p,q)}$, and $xa_{3-(p,q)}$) that include a corrected input signal of the first sub-pixel 49R having a signal value of $xa_{1-(p,q)}$, a corrected input signal of the second sub-pixel 49G having a signal value of $xa_{2-(p,q)}$, and a corrected input signal of the third sub-pixel 49B having a signal value of $xa_{3-(p,q)}$. Specifically, the color conversion unit 23 stores therein the following expression (1). As represented by the following expression (1), an array of the input signals ($x_{1-(p,q)}$, $x_{2-(p,q)}$, and $x_{3-(p,q)}$) is multiplied by a color conversion matrix (a conversion matrix of three rows and three columns) to be converted into the corrected input signals ($xa_{1-(p,q)}$, $xa_{2-(p,q)}$, and $xa_{3-(p,q)}$) of R, G, and B in the color conversion unit 23.

$$\begin{pmatrix} Xa_{1-(p,q)} \\ Xa_{2-(p,q)} \\ Xa_{3-(p,q)} \end{pmatrix} = \begin{pmatrix} RR & GR & BR \\ RG & GG & BG \\ RB & GB & BB \end{pmatrix} \times \begin{pmatrix} X_{1-(p,q)} \\ X_{2-(p,q)} \\ X_{3-(p,q)} \end{pmatrix}. \quad (1)$$

where RR, RG, RB, GR, GG, GB, BR, BG, and BB appearing in the expression (1) are predetermined coefficients. The color conversion unit 23 stores values of RR, RG, RB, GR, GG, GB, BR, BG, and BB. The values of RR, RG, RB, GR, GG, GB, BR, BG, and BB determine how the color conversion processing generates the corrected input signals. The color conversion processing according to the first embodiment will be described later. The color conversion unit 23 stores each the values of the coefficients RR, RG, RB, GR, GG, GB, BR, BG, and BB as a constant value. The color conversion unit 23 may, however, change the values of the stored coefficients RR, RG, RB, GR, GG, GB, BR, BG, and BB, for example, according to setting change processing by the observer.

Based on the corrected input signals received from the color conversion unit 23, the expansion processing unit 24 performs expansion processing to generate output signals that include data of a white (W) component for driving the fourth sub-pixel 49W in the pixel 48. The expansion processing unit 24 then outputs the generated output signals to the gamma correction unit 25. The expansion processing will be described later.

If, for example, the input signals and the corrected input signals are RGB data represented by 8 bits (0 to 255) as described above, the gamma correction unit 25 converts the corrected input signals received from the expansion processing unit 24 into 8-bit data type, which is the same as that of the input signals and corrected input signals. In addition, the gamma correction unit 25 gamma-corrects the converted 8-bit data with a gamma value (such as a gamma of 2.2) of the input signals having been gamma-corrected, and outputs the gamma-corrected output signals. The gamma correction unit 25 converts the output signals into the 8-bit data type, which is the same as that of the input signals. However, the gamma correction unit 25 need not match the bit depth of the output signals with that of the input signals.

The functions of the linear conversion unit 22, the color conversion unit 23, the expansion processing unit 24, and the gamma correction unit 25 may be implemented by hardware or software, and are not limited to be implemented by either. When each of the units of the signal processing unit 20 is configured by hardware, the units need not be physically distinguished as independent of one another, but the functions may be implemented by a physically single circuit. The signal processing unit 20 need not include the I/F control unit 21, the linear conversion unit 22, and the gamma correction unit 25, but only needs to include the color conversion unit 23 and the expansion processing unit 24, and perform the color conversion processing and the expansion processing. In this case, the signal processing unit 20 does not perform the gamma conversion processing and so on; the color conversion unit 23 directly receives the input signals and performs the color conversion processing; and the expansion processing unit 24 performs the expansion processing to generate the output signals and outputs them.

As illustrated in FIGS. 1 and 3, the image-display-panel driving unit 30 includes a signal output circuit 31 and a scanning circuit 32. In the image-display-panel driving unit 30, the signal output circuit 31 holds video signals and sequentially outputs them to the image display panel 40. More specifically, the signal output circuit 31 outputs image output signals having certain electric potentials corresponding to the output signals from the signal processing unit 20 to the image display panel 40. The signal output circuit 31 is electrically coupled to the image display panel 40 through signal lines DTL. The scanning circuit 32 controls on/off of each switching element (for example, TFT) for controlling an operation (optical transmittance) of the sub-pixel 49 in the image display panel 40. The scanning circuit 32 is electrically coupled to the image display panel 40 through wiring SCL.

Figure 6:
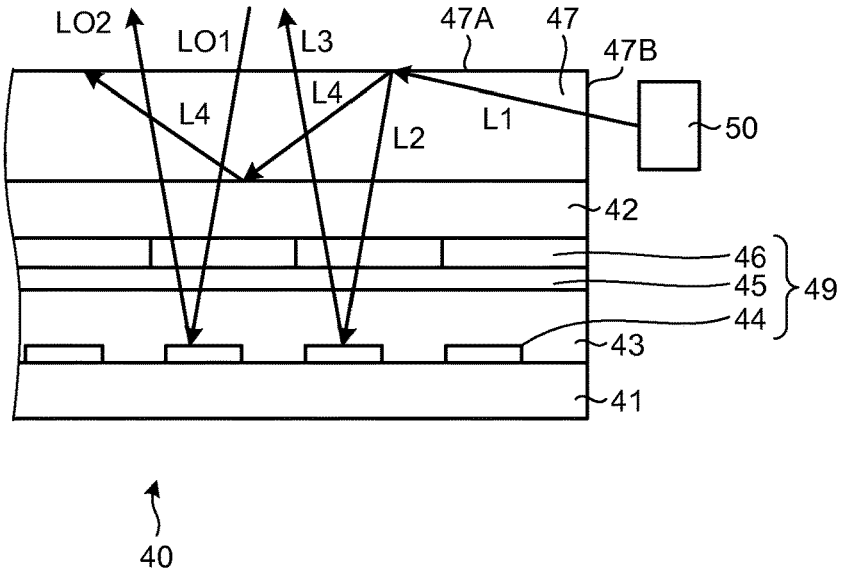
FIG. 6 is a sectional view schematically illustrating a structure of the image display panel according to the first embodiment.

FIG. 6 is a sectional view schematically illustrating a structure of the image display panel according to the first embodiment. As illustrated in FIG. 6, the image display panel 40 includes an array substrate 41 and a counter substrate 42 facing each other, and a liquid crystal layer 43 including liquid crystal elements is provided between the array substrate 41 and the counter substrate 42.

A plurality of pixel electrodes 44 are provided on the liquid crystal layer 43 side of the array substrate 41. The pixel electrodes 44 are coupled to the signal lines DTL via the switching elements, and receive the image output signals as the video signals applied thereto. The pixel electrodes 44 are reflective members of, for example, aluminum or silver, and reflect external light or light from the light source unit 50. In other words, the pixel electrodes 44 constitute reflectors in the first embodiment.

The counter substrate 42 is a transparent substrate, such as a glass substrate. A counter electrode 45 and color filters 46 are provided on the liquid crystal layer 43 side of the counter substrate 42. More specifically, the counter electrode 45 is provided on surfaces of the color filters 46 facing the liquid crystal layer 43.

The counter electrode 45 is made of a transparent conductive material, such as indium tin oxide (ITO) or indium zinc oxide (IZO). The counter electrode 45 is coupled to the switching elements, which are coupled to the pixel electrodes 44. Each of the pixel electrodes 44 and the counter electrode 45 are provided facing each other. Due to this, when a voltage corresponding to each of the image output signals is applied between the pixel electrode 44 and the counter electrode 45, the pixel electrode 44 and the counter electrode 45 produce an electric field in the liquid crystal layer 43. The electric field produced in the liquid crystal layer 43 twists the liquid crystal elements to change the birefringence index thereof, and thus, the display device 10 adjusts the quantity of light reflected from the image display panel 40. The image display panel 40 is what is called a vertical electric field mode panel, but may be a horizontal electric field mode panel in which the electric field is produced parallel to the display surface of the image display panel 40.

The color filters 46 are the first, the second, and the third color filters described above, and are provided so as to correspond to the pixel electrodes 44. Each of the pixel electrodes 44, the counter electrode 45, and corresponding one of the color filters 46 constitute the sub-pixel 49.

A light guide plate 47 is provided on a side opposite to the liquid crystal layer 43 side of the counter substrate 42. The light guide plate 47 is a transparent plate-like member of, for example, an acrylic resin, a polycarbonate (PC) resin, or a methyl methacrylate-styrene copolymer (MS resin). Prisms are formed on an upper surface 47A of the light guide plate 47 that is a surface opposite to the counter substrate 42.

The light source unit 50 is LEDs in the first embodiment. As illustrated in FIG. 6, the light source unit 50 is provided along a side surface 47B of the light guide plate 47. The light source unit 50 irradiates the image display panel 40 with light from the front surface of the image display panel 40 through the light guide plate 47. The light source unit 50 is switched on and off, for example, by operation of the image observer or by an external light sensor that is mounted on the display device 10 and measures external light. The light source unit 50 emits light when being on, and does not emit light when being off. For example, when the image observer feels an image to be dark, the image observer turns on the light source unit 50 to irradiate the image display panel 40 with light from the light source unit 50 so as to brighten the image. When the external light sensor determines that the external light intensity is lower than a predetermined value, the signal processing unit 20, for example, turns on the light source unit 50 to irradiate the image display panel 40 with light from the light source unit 50 so as to brighten the image. In the first embodiment, the signal processing unit 20 does not control the luminance of light of the light source unit 50 according to an expansion coefficient $\alpha$. In other words, the luminance of light of the light source unit 50 is set independently of the expansion coefficient $\alpha$ to be described later. The luminance of light of the light source unit 50 may, however, be adjusted according to operation of the image observer or a measurement result of the external light sensor.

The following describes reflection of light by the image display panel 40. As illustrated in FIG. 6, external light LO1 is incident on the image display panel 40. The external light LO1 is incident on each of the pixel electrodes 44 through the light guide plate 47 and the image display panel 40. The external light LO1 incident on the pixel electrode 44 is reflected by the pixel electrode 44, and exits, as light L02, to the outside through the image display panel 40 and the light guide plate 47. Turning on the light source unit 50 causes light L1 from the light source unit 50 to be incident from the side surface 47B into the light guide plate 47. The light L1 incident into the light guide plate 47 is scattered and reflected on the upper surface 47A of the light guide plate 47. A part of the reflected light is incident, as light L2, on the image display panel 40 from the counter substrate 42 side of the image display panel 40, and is projected on the pixel electrode 44. The light L2 projected on the pixel electrode 44 is reflected by the pixel electrode 44, and exits, as light L3, to the outside through the image display panel 40 and the light guide plate 47. The other part of the light scattered on the upper surface 47A of the light guide plate 47 is reflected as light L4, and repeats being reflected in the light guide plate 47.

In other words, the pixel electrodes 44 reflect the external light LO1 and/or the light L2 toward the outside, the external light LO1 being incident on the image display panel 40 from the front surface thereof that is a surface on the external side (the counter substrate 42 side) of the image display panel 40. The light LO2 and the light L3 reflected toward the outside pass through the liquid crystal layer 43 and the color filters 46. Due to this, the display device 10 can display an image with the light LO2 and the light L3. As described above, the display device 10 according to the first embodiment is a reflective display device that is of a front light type and includes the light source unit 50 of an edge light type. Although the display device 10 includes the light source unit 50 and the light guide plate 47 in the first embodiment, the display device 10 need not include the light source unit 50 and the light guide plate 47. In this case, the display device 10 can display the image with the light LO2 obtained by reflecting the external light LO1.

Processing Operation of Display Device

Figure 7:
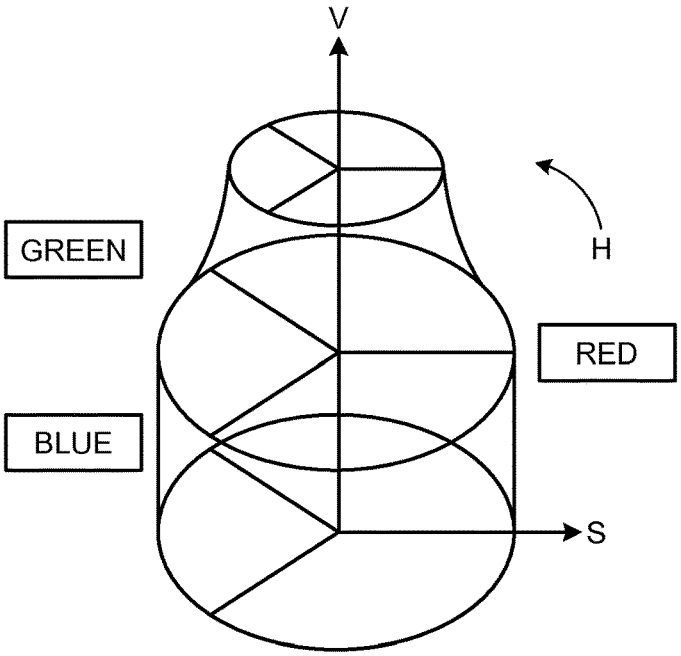
FIG. 7 is a conceptual diagram of an extended HSV color space that can be extended by the display device according to the first embodiment.
Figure 8:
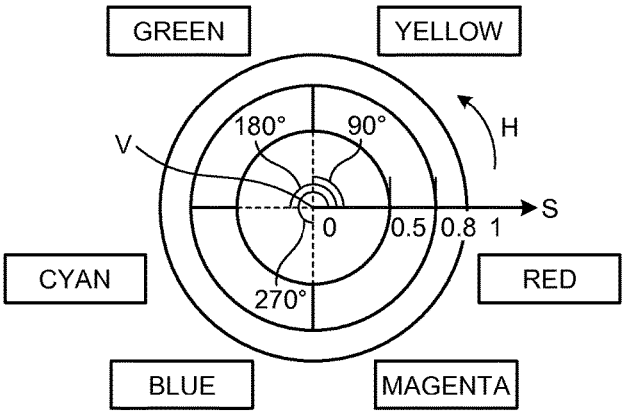
FIG. 8 is a conceptual diagram illustrating a relation between a hue and saturation in the extended HSV color space.

FIG. 7 is a conceptual diagram of the extended HSV color space that can be extended by the display device according to the first embodiment. FIG. 8 is a conceptual diagram illustrating a relation between a hue and saturation in the extended HSV color space. The signal processing unit 20 receives from the outside the input signals that are information (color information) of the image to be displayed. The input signals include information (color information) as an input signal for each pixel displaying the image at the position thereof. Specifically, in the image display panel 40 in which the $P_0 \times Q_0$ pixels 48 are arranged in a matrix, with respect to the (p,q)-th pixel 48 (where $1 \leq p \leq P_0$ and $1 \leq q \leq Q_0$), the signal processing unit 20 receives the input signals including the input signal of the first sub-pixel 49R having a signal value of $x_{1-(p,q)}$, the input signal of the second sub-pixel 49G having a signal value of $x_{2-(p,q)}$, and the input signal of the third sub-pixel 49B having a signal value of $x_{3-(p,q)}$ (refer to FIG. 1).

The signal processing unit 20 illustrated in FIG. 1 processes the input signals to generate an output signal (signal value $X_{1-(p,q)}$) for the first sub-pixel for determining the display gradation of the first sub-pixel 49R, an output signal (signal value $X_{2-(p,q)}$) for the second sub-pixel for determining the display gradation of the second sub-pixel 49G, an output signal (signal value $X_{3-(p,q)}$) for the third sub-pixel for determining the display gradation of the third sub-pixel 49B, and an output signal (signal value $X_{4-(p,q)}$) for the fourth sub-pixel for determining the display gradation of the fourth sub-pixel 49W, and outputs the generated output signals to the image-display-panel driving unit 30.

In the display device 10, the pixel 48 includes the fourth sub-pixel 49W for outputting the fourth color (white) so as to be capable of widening a dynamic range of brightness in the HSV color space (extended HSV color space) as illustrated in FIG. 7. Specifically, as illustrated in FIG. 7, the shape of the extended HSV color space is obtained by placing a substantially truncated cone that reduces the maximum of brightness V as saturation S increases on a cylindrical HSV color space that can be displayed by the first sub-pixel 49R, the second sub-pixel 49G, and the third sub-pixel 49B. The signal processing unit 20 stores therein the maximum value Vmax(S) of the brightness the variable of which is the saturation S in the HSV color space that is expanded by adding the fourth color (white). Specifically, the signal processing unit 20 stores therein the maximum value Vmax(S) of the brightness for each pair of coordinates (coordinate values) of the saturation and the hue regarding the three-dimensional shape of the HSV color space illustrated in FIG. 7. The input signals include the input signals of the first sub-pixel 49R, the second sub-pixel 49G, and the third sub-pixel 49B, so that the HSV color space of the input signals has a cylindrical shape, that is, the same shape as a cylindrical part of the extended HSV color space.

The color conversion unit 23 of the signal processing unit 20 applies the color conversion processing to the input signals to generate the corrected input signals. Specifically, based on the input signal (signal value $x_{1-(p,q)}$) of the first sub-pixel 49R, the input signal (signal value $x_{2-(p,q)}$) of the second sub-pixel 49G, and the input signal (signal value $x_{3-(p,q)}$) of the third sub-pixel 49B and using the expression (1), the signal processing unit 20 generates the corrected input signal (signal value $xa_{1-(p,q)}$) of the first sub-pixel 49R, the corrected input signal (signal value $xa_{2-(p,q)}$) of the second sub-pixel 49G, and the corrected input signal (signal value $xa_{3-(p,q)}$) of the third sub-pixel 49B. The color conversion processing will be described later.

Then, based on at least the corrected input signal (signal value $xa_{1-(p,q)}$) of the first sub-pixel 49R and the expansion coefficient α, the signal processing unit 20 calculates the output signal (signal value $X_{1-(p,q)}$) for the first sub-pixel 49R, and outputs the result to the first sub-pixel 49R. Based on at least the corrected input signal (signal value $xa_{2-(p,q)}$) of the second sub-pixel 49G and the expansion coefficient α, the signal processing unit 20 calculates the output signal (signal value $X_{2-(p,q)}$) for the second sub-pixel 49G, and outputs the result to the second sub-pixel 49G. Based on at least the corrected input signal (signal value $xa_{3-(p,q)}$) of the third sub-pixel 49B and the expansion coefficient α, the signal processing unit 20 calculates the output signal (signal value $X_{3-(p,q)}$) for the third sub-pixel 49B, and outputs the result to the third sub-pixel 49B. In addition, based on the corrected input signal (signal value $xa_{1-(p,q)}$) of the first sub-pixel 49R, the corrected input signal (signal value $xa_{2-(p,q)}$) of the second sub-pixel 49G, and the corrected input signal (signal value $xa_{3-(p,q)}$) of the third sub-pixel 49B, the signal processing unit 20 calculates the output signal (signal value $X_{4-(p,q)}$) for the fourth sub-pixel 49W, and outputs the result to the fourth sub-pixel 49W. In other words, the signal processing unit 20 generates the output signals based on the corrected input signals after the color conversion.

Specifically, the signal processing unit 20 calculates the output signal for the first sub-pixel based on the corrected input signal of the first sub-pixel, the expansion coefficient α, and the output signal for the fourth sub-pixel, calculates the output signal for the second sub-pixel based on the corrected input signal of the second sub-pixel, the expansion coefficient α, and the output signal for the fourth sub-pixel, and calculates the output signal for the third sub-pixel based on the corrected input signal of the third sub-pixel, the expansion coefficient α, and the output signal for the fourth sub-pixel.

That is, when χ is defined as a constant depending on the display device, the signal processing unit 20 obtains, from the following expressions (2) to (4), the signal value $X_{1-(p,q)}$ serving as the output signal value for the first sub-pixel, the signal value $X_{2-(p,q)}$ serving as the output signal value for the second sub-pixel, and the signal value $X_{3-(p,q)}$ serving as the output signal value for the third sub-pixel, the signal values being output to the (p,q)-th pixel (or a group of the first sub-pixel 49R, the second sub-pixel 49G, and the third sub-pixel 49B).

$$X_{1-(p,q)}=\alpha\cdot xa_{1-(p,q)}-\chi\cdot X_{4-(p,q)} \tag{2}$$

$$X_{2-(p,q)}=\alpha\cdot xa_{2-(p,q)}-\chi\cdot X_{4-(p,q)} \tag{3}$$

$$X_{3-(p,q)}=\alpha\cdot Xa_{3-(p,q)}-\chi\cdot X_{4-(p,q)} \tag{4}$$

The signal processing unit 20 stores therein the maximum value Vmax(S) of the brightness the variable of which is the saturation S in the color space (for example, the HSV color space) expanded by adding the fourth color. The expansion processing unit 24 of the signal processing unit 20 obtains the saturation S and the brightness V(S) based on the corrected input signal values of the sub-pixels 49 in the pixels 48. The expansion processing unit 24 of the signal processing unit 20 calculates the expansion coefficient α based on the maximum value Vmax(S) of the brightness and the brightness V(S) of the sub-pixels 49.

The saturation S and the brightness V(S) are expressed as follows: S=(Max−Min)/Max, and V(S)=Max. The saturation S takes values of 0 to 1, and the brightness V(S) takes values of 0 to (2×n−1), where n is the number of bits used to indicate the display gradation. Max is the maximum value among the corrected input signal value of the first sub-pixel 49R, the corrected input signal value of the second sub-pixel 49G, and the corrected input signal value of the third sub-pixel 49B, the signal values being supplied to the pixel 48. Min is the minimum value among the corrected input signal value of the first sub-pixel 49R, the corrected input signal value of the second sub-pixel 49G, and the corrected input signal value of the third sub-pixel 49B, the signal values being supplied to the pixel 48. A hue H is represented in the range from 0° to 360° as illustrated in FIG. 8. Red, yellow, green, cyan, blue, magenta, and red are arranged from 0° toward 360°.

In the first embodiment, the signal value $X_{4-(p,q)}$ of the output signal for the fourth sub-pixel 49W can be obtained based on the product of the $Min_{(p,q)}$ and the expansion coefficient α. Specifically, the signal value $X_{4-(p,q)}$ can be obtained based on the following expression (5). In the expression (5), the product of the $Min_{(p,q)}$ and the expansion coefficient α is divided by χ. However, the calculation expression is not limited to this. χ will be described later.

$$X_{4-(p,q)}=Min_{(p,q)}\cdot\alpha/\chi \tag{5}$$

In the (p,q)-th pixel, the saturation $S_{(p,q)}$ and the brightness $V(S)_{(p,q)}$ in the cylindrical HSV color space can be obtained from the following expressions (6) and (7) based on the corrected input signal (signal value $xa_{1-(p,q)}$) of the first sub-pixel 49R, the corrected input signal (signal value $xa_{2-(p,q)}$) of the second sub-pixel 49G, and the corrected input signal (signal value $xa_{3-(p,q)}$) of the third sub-pixel 49B.

$$S_{(p,q)}=(Max_{(p,q)}-Min_{(p,q)})/Max_{(p,q)} \tag{6}$$

$$V(S)_{(p,q)}=Max_{(p,q)} \tag{7}$$

where $Max_{(p,q)}$ is the maximum value among the corrected input signal values ($xa_{1-(p,q)}$, $xa_{2-(p,q)}$, and $xa_{3-(p,q)}$) of three sub-pixels 49, and $Min_{(p,q)}$ is the minimum value of the corrected input signal values ($xa_{1-(p,q)}$, $xa_{2-(p,q)}$, and $xa_{3-(p,q)}$) of three sub-pixels 49. In the present embodiment, n is 8. That is, the number of bits used to indicate the display gradation is 8 (the value of the display gradation is from 0 to 255 giving a total of 256 gradations).

No color filter but a transparent resin layer is provided for the fourth sub-pixel 49W that displays white. Supposing that a signal having a value corresponding to the maximum signal value of the output signal for the first sub-pixel is supplied to the first sub-pixel 49R, a signal having a value corresponding to the maximum signal value of the output signal for the second sub-pixel is supplied to the second sub-pixel 49G, and a signal having a value corresponding to the maximum signal value of the output signal for the third sub-pixel is supplied to the third sub-pixel 49B, the luminance of an aggregate of the first, the second, and the third sub-pixels 49R, 49G, and 49B included in the pixel 48 or a group of pixels 48 is denoted as $BN_{1-3}$. Supposing that a signal having a value corresponding to the maximum signal value of the output signal for the fourth sub-pixel 49W is supplied to the fourth sub-pixel 49W included in the pixel 48 or a group of pixels 48, the luminance of the fourth sub-pixel 49W is denoted as $BN_4$. That is, the aggregate of the first, the second, and the third sub-pixels 49R, 49G, and 49B display white at the maximum luminance, and the luminance of the white is represented by $BN_{1-3}$. Assuming that $\chi$ is a constant depending on the display device, the constant $\chi$ is represented by $\chi=BN_4/BN_{1-3}$.

Specifically, the luminance $BN_4$ when the input signal having a value of display gradation of 255 is assumed to be supplied to the fourth sub-pixel 49W is, for example, 1.5 times the luminance $BN_{1-3}$ of white when the input signals having the following values of display gradation are supplied to the aggregate of the first, the second, and the third sub-pixels 49R, 49G, and 49B: the signal value $x_{1-(p,q)}=255$, the signal value $x_{2-(p,q)}=255$, and the signal value $x_{3-(p,q)}=255$. That is, $\chi=1.5$ in the first embodiment.

When the signal value $X_{4-(p,q)}$ of the output signal for the fourth sub-pixel 49W is represented by the expression (5) given above, Vmax(S) can be represented by the following expressions (8) and (9).

When $S \leq S_0$:

$$V\max(S)=(\chi+1)\cdot(2^n-1) \tag{8}$$

When $S_0<S\leq 1$:

$$V\max(S)=(2^n-1)\cdot(1/S) \tag{9}$$

where $S_0=1/(\chi+1)$.

The obtained maximum value Vmax(S) of the brightness the variable of which is the saturation S in the HSV color space expanded by adding the fourth color is stored in the signal processing unit 20 as a kind of look-up table, for example. Alternatively, the signal processing unit 20 obtains the maximum value Vmax(S) of the brightness the variable of which is the saturation S in the expanded HSV color space as need arises.

The following describes a method for obtaining the signal values $X_{1-(p,q)}$, $X2-(p,q)$, $X_{3-(p,q)}$, and $X_{4-(p,q)}$ as output signals for the (p,q)-th pixel 48 (expansion processing). The following processing is performed so as to keep a ratio among the luminance of the first primary color displayed by (first sub-pixel 49R+fourth sub-pixel 49W), the luminance of the second primary color displayed by (second sub-pixel 49G+fourth sub-pixel 49W), and the luminance of the third primary color displayed by (third sub-pixel 49B+fourth sub-pixel 49W). The processing is performed so as to also keep (maintain) color tone. The processing is performed so as to keep (maintain), furthermore, a gradation-luminance characteristic (gamma characteristic or $\gamma$ characteristic).

First Process

First, the color conversion unit 23 of the signal processing unit 20 applies the color conversion processing to the input signals to generate the corrected input signals. Specifically, the color conversion unit 23 generates the corrected input signal (signal value $xa_{1-(p,q)}$) of the first sub-pixel 49R, the corrected input signal (signal value $xa_{2-(p,q)}$) of the second sub-pixel 49G, and the corrected input signal (signal value $xa_{3-(p,q)}$) of the third sub-pixel 49B, using the expression (1), based on the signal value $x_{1-(p,q)}$ that is the input signal of the first sub-pixel 49R, the signal value $x_{2-(p,q)}$ that is the input signal of the second sub-pixel 49G, and the signal value $x_{3-(p,q)}$ that is the input signal of the third sub-pixel 49B, the signal values being supplied to the (p,q)-th pixel 48. The signal processing unit 20 applies this processing to all the input signals. The color conversion processing will be described later.

Second Process

Then, based on the corrected input signal values of the sub-pixels 49 in the pixels 48, the expansion processing unit 24 of the signal processing unit 20 obtains the saturation S and the brightness V(S) of the pixels 48. Specifically, $S_{(p,q)}$ and $V(S)_{(p,q)}$ are obtained through the expressions (6) and (7) based on the signal value $xa_{1-(p,q)}$ of the corrected input signal of the first sub-pixel 49R, the signal value $xa_{2-(p,q)}$ of the corrected input signal of the second sub-pixel 49G, and the signal value $xa_{3-(p,q)}$ of the corrected input signal of the third sub-pixel 49B, the signal values being supplied to the (p,q)-th pixel 48. The signal processing unit 20 applies this processing to all the pixels 48.

Third Process

Then, the signal processing unit 20 obtains the expansion coefficient $\alpha(S)$, using the following expression (10), based on Vmax(S)/V(S) obtained with respect to the pixels 48.

$$\alpha(S)=V\max(S)/V(S) \tag{10}$$

Fourth Process

Then, the signal processing unit 20 obtains the signal value $X_{4-(p,q)}$ for the (p,q)-th pixel 48 based on at least the signal value $xa_{1-(p,q)}$ of the corrected input signal, the signal value $xa_{2-(p,q)}$ of the corrected input signal, and the signal value $xa_{3-(p,q)}$ of the corrected input signal. In the present embodiment, the signal processing unit 20 determines the signal value $X_{4-(p,q)}$ based on $Min_{(p,q)}$, the expansion coefficient $\alpha$, and the constant $\chi$. More specifically, as described above, the signal processing unit 20 obtains the signal value $X_{4-(p,q)}$ based on the expression (5) given above. The signal processing unit 20 obtains the signal value $X_{4-(p,q)}$ for every one of the $P_0 \times Q_0$ pixels 48.

Fifth Process

Thereafter, the signal processing unit 20 obtains the signal value $X_{1-(p,q)}$ for the (p,q)-th pixel 48 based on the signal value $xa_{1-(p,q)}$ of the corrected input signal, the expansion coefficient $\alpha$, and the signal value $X_{4-(p,q)}$, obtains the signal value $X_{2-(p,q)}$ for the (p,q)-th pixel 48 based on the signal value $xa_{2-(p,q)}$ of the corrected input signal, the expansion coefficient $\alpha$, and the signal value $X_{4-(p,q)}$, and obtains the signal value $X_{3-(p,q)}$ for the (p,q)-th pixel 48 based on the signal value $xa_{3-(p,q)}$ of the corrected input signal, the expansion coefficient $\alpha$, and the signal value $X_{4-(p,q)}$. Specifically, the signal processing unit 20 obtains the signal value $X_{1-(p,q)}$, the signal value $X_{2-(p,q)}$, and the signal value $X_{3-(p,q)}$ for the (p,q)-th pixel 48 based on the expressions (2) to (4) given above.

The signal processing unit 20 expands the value of $Min_{(p,q)}$ with $\alpha$ as represented by the expression (5). In this way, the expansion of the value of $Min_{(p,q)}$ with $\alpha$ increases the luminance of the white display sub-pixel (fourth sub-pixel 49W), and also increases the luminance of the red display sub-pixel, the green display sub-pixel, and the blue display sub-pixel (corresponding to the first, the second, and the third sub-pixels 49R, 49G, and 49B, respectively) as represented by the expressions given above. This increase in the luminance can avoid problems, such as dullness of color. In the first embodiment, the luminance of the light source unit 50 is constant, independently of the expansion coefficient $\alpha$. That is, expanding the value of $Min_{(p,q)}$ with $\alpha$ increases the luminance of the entire image to $\alpha$ times that obtained in the case in which the value of $Min_{(p,q)}$ is not expanded. As a result, for example, a still image and the like can preferably be displayed with high luminance.

Color Conversion Processing

The following describes the color conversion processing in the first embodiment in comparison with a comparative example. The display device 10 according to the first embodiment performs the color conversion processing so as to correct a certain color represented by the input signals into a corrected color that is a color positioned in a direction away from a white point displaying white in the reference color gamut, and thus corrects the signal values of the input signals into signal values including color information of the corrected color to generate corrected signals including the color information of the corrected color.

Figure 9:
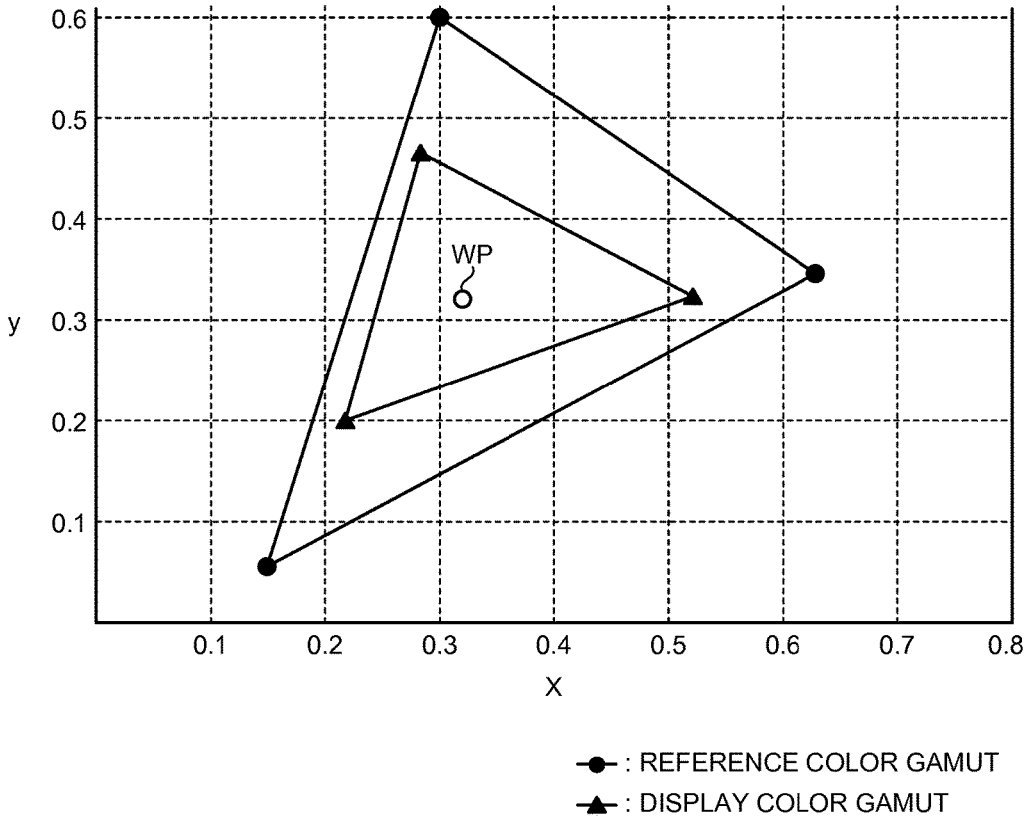
FIG. 9 is a diagram illustrating a relation between a reference color gamut that can be represented by input signals and a display color gamut that can be displayed by the display device according to the first embodiment in an XYZ color coordinate system.

FIG. 9 is a diagram illustrating a relation between the reference color gamut that can be represented by the input signals and a display color gamut that can be displayed by the display device according to the first embodiment in an XYZ color coordinate system. FIG. 9 illustrates the reference color gamut and the display color gamut that can be displayed by the display device 10 in the XYZ color coordinate system. In FIG. 9, the vertical axis represents the y-axis, and the horizontal axis represents the x-axis. The XYZ color coordinate system is a form of color representation that allows positive numbers (X, Y, and Z) to represent all colors distinguishable by a human eye. Suppose that $x=X/(X+Y+Z)$, $y=Y/(X+Y+Z)$, and $z=Z/(X+Y+Z)$, the following is satisfied: $x+y+z=1$, where x, y, and z respectively represent ratios of X, Y, and Z to the sum of X, Y, and Z. In this case, a relation $z=1-x-y$ is satisfied, so that z is obtained by determining x and y. Therefore, all colors can be represented by only x and y.

As described above, the input signals include the color information of the certain color represented in the reference color gamut. In the first embodiment, the reference color gamut is the color gamut of the sRGB standard. In other words, the input signals can represent a color in the color gamut of the sRGB standard. The reference color gamut illustrated in FIG. 9 is a color gamut obtained by displaying the color gamut of the sRGB standard in the XYZ color coordinate system. Specifically, when a color represented by the color information included in the input signals is defined as an "input color", the input signals can represent the certain color in the reference color gamut illustrated in FIG. 9 as the input color. The display device 10 according to the first embodiment cannot express all colors in the color gamut of the sRGB standard represented by the input signals because the display device 10 displays the image by reflecting the light obtained from the light source unit 50 or the external light. Specifically, when a color that can be expressed by the display device 10 is defined as a "display color", the display device 10 can express only colors in a display color gamut that is smaller than the reference color gamut illustrated in FIG. 9. When the display device 10 performs the expansion processing based on the input signals and displays the image based on the output signals calculated by the expansion processing, the input color is converted into the display color positioned in the display color gamut and displayed. In other words, when the display device 10 displays the input color in the reference color gamut, the color of the input color is converted and displayed as the display color in the display color gamut.

As illustrated in FIG. 9, the reference color gamut and the display color gamut includes a white point WP at a common place in those color gamut areas. The white point WP is a place where white is represented in the reference color gamut and the display color gamut. In other words, a color positioned at the white point WP is displayed as white. In FIG. 9, the reference color gamut and the display color gamut are displayed in the XYZ color coordinate system, so that the white point WP in those color gamut areas is positioned at coordinates where white is displayed in the XYZ color coordinate system. In the example illustrated in FIG. 9, the display color gamut is smaller than the reference color gamut, and is a color gamut having an NTSC ratio of 28% relative to the reference color gamut. However, the region of the display color gamut is not limited to this area, but varies depending on, for example, the color filters or the light obtained from the light source unit 50 or the external light. The configuration may be such that white points of the reference color gamut and the display color gamut are provided at different places of the XY coordinates.

Figure 10:
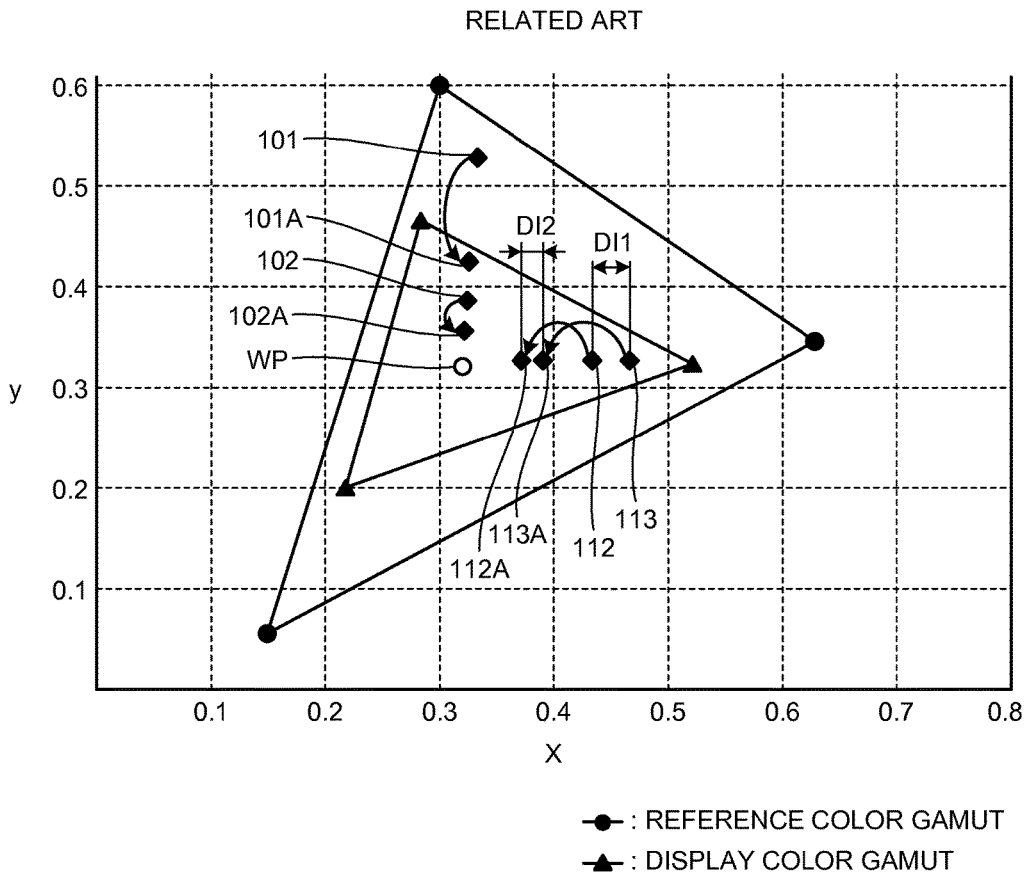
FIG. 10 is a schematic diagram illustrating an example of display colors expressed by a display device according to a comparative example.
Figure 11:
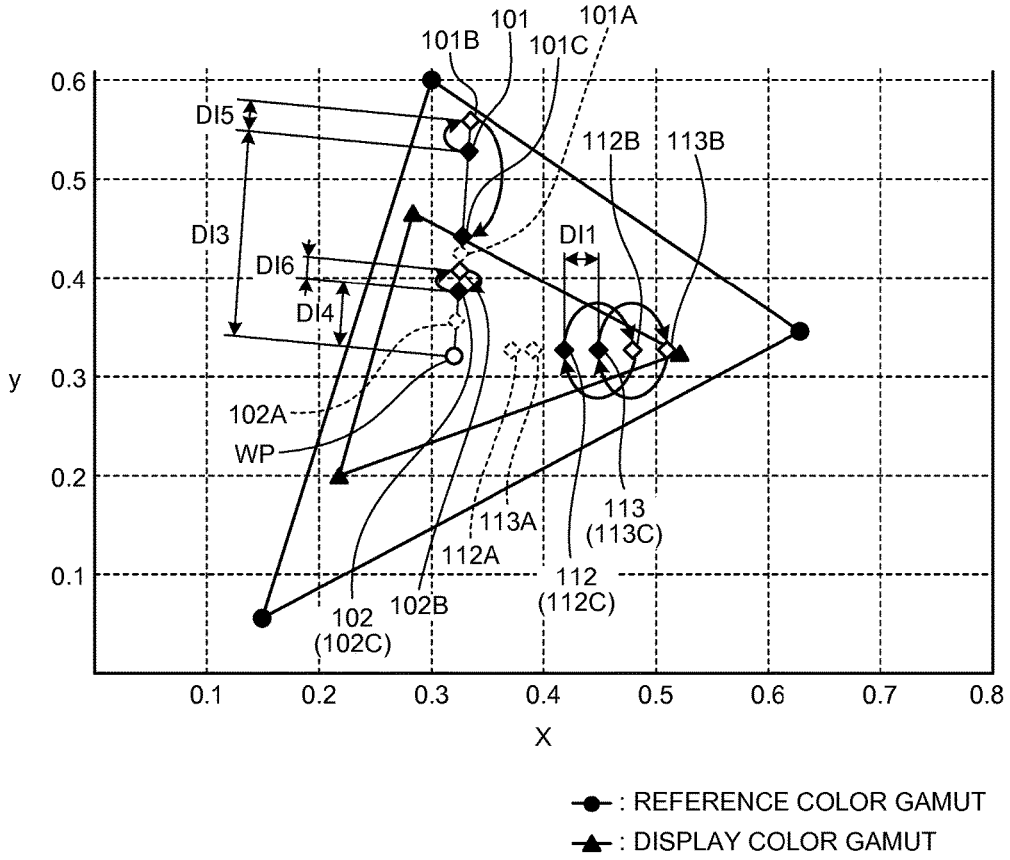
FIG. 11 is a schematic diagram illustrating an example of display colors expressed by the display device according to the first embodiment.

FIG. 10 is a schematic diagram illustrating an example of display colors expressed by a display device according to a comparative example. FIG. 11 is a schematic diagram illustrating an example of display colors expressed by the display device according to the first embodiment. FIGS. 10 and 11 also illustrate the XYZ color coordinate system in the same way as FIG. 9. A display device 10Z according to the comparative example is a reflective display device having the same configuration as that of the display device 10 according to the first embodiment, and can express only colors in a display color gamut common to the display device 10 according to the first embodiment. The display device 10Z according to the comparative example, however, does not perform the color conversion processing. Specifically, the display device 10Z according to the comparative example does not convert the input signals into the corrected input signals, but directly generates the output signals from the input signals.

The following describes, as an example, an input color 101 that represents a color inside the reference color gamut and outside the display color gamut and an input color 102 that represents a color inside the display color gamut.

As illustrated in FIG. 10, when the display device 10Z according to the comparative example is caused to generate the output signals based on the input signals representing the input color 101 and display the display color based on the generated output signals, a display color 101A corresponding to the input color 101 is displayed. In other words, although the display device 10Z is caused to express the input color 101, the display device 10Z results in displaying the display color 101A inside the display color gamut that is a color more close to the white point WP than the input color 101. In the same way, although the display device 10Z according to the comparative example is caused to express the input color 102 that is a color inside the display color gamut, the display device 10Z results in displaying a display color 102A inside the display color gamut that is a color more close to the white point WP than the input color 102. Thus, although the display device 10Z is caused to display the input color specified by the input signals, the display device 10Z results in displaying the display color inside the display color gamut that is paler (more close to white) than the input color, so that the display quality may deteriorate.

In addition, the following describes an input color 112 that represents a color inside the display color gamut and an input color 113 that represents a color inside the display color gamut and lies at a place more away from the white point WP than the input color 112.

When the display device 10Z according to the comparative example is caused to express the input color 112, the display device 10Z results in displaying a display color 112A that is a color more close to the white point WP than the input color 112. In the same way, when the display device 10Z is caused to express the input color 113, the display device 10Z results in displaying a display color 113A that is a color more close to the white point WP than the input color 113. As illustrated in FIG. 10, a distance DI2 between the coordinates of the display color 112A and the coordinates of the display color 113A in the XYZ color coordinate system is smaller than a distance DI1 between the coordinates of the input color 112 and the coordinates of the input color 113 in the XYZ color coordinate system. In other words, in the case of expressing different colors inside the display color gamut, the display device 10Z results in expressing the different colors as colors more close to each other. Due to this, the display device 10Z may reduce contrast between the different colors and deteriorate the display quality.

In contrast, the display device 10 according to the first embodiment converts the input signals into the corrected input signals so as to correct the input color in the reference color gamut into the corrected color that is a color having coordinates of a position in a direction away from the white point, and generates the output signals based on the corrected input signals. In other words, the display device 10Z according to the comparative example displays the display color corresponding to the input color, while the display device 10 according to the first embodiment displays the display color corresponding to the corrected color after the color conversion. In this case, the white point may be either of the white point in the reference color gamut and the white point in the display color gamut if the white points in the reference color gamut and the display color gamut are provided at different places by the XY coordinates described above. The display device 10 according to the first embodiment generates the corrected input signals so that the corrected color changes corresponding to the input color. More specifically, the display device 10 generates the corrected input signals so that the coordinates of the corrected color in the reference color gamut are more away from the coordinates of the input color in the reference color gamut as the input color is more away from the white point. In the same way, in this case, the white point may be either of the white point in the reference color gamut and the white point in the display color gamut if the white points in the reference color gamut and the display color gamut are provided at different places by the XY coordinates described above. In this case, for example, if the white point is based on the reference color gamut, the color conversion processing is performed based on the reference color gamut based on the input signals, so that the color conversion processing can be easily performed. If the white point is based on the display color gamut, the color conversion processing is performed based on the display color gamut to which an actually displayed display color belongs, so that the color conversion processing can be suitably performed.

In this way, in the color conversion processing, the display device 10 according to the first embodiment generates the corrected input signals from the input signals so as to correct the input color represented by the input signals into the corrected color positioned in the direction away from the white point. Specifically, the display device 10 performs the color conversion processing as described above by defining the values of RR, RG, RB, GR, GG, GB, BR, BG, and BB that are the predetermined coefficients appearing in the expression (1), and using the expression (1) based on the defined values. In this case, at least one of RR, GG, and BB is preferably a value greater than 1. This processing generates the corrected input signals so that the corrected color becomes a color more away from the white point than the input color.

As illustrated in FIG. 11, the display device 10 according to the first embodiment corrects the input signals into the corrected input signals to convert the input color 101 into a corrected color 101B. As illustrated in FIG. 11, the corrected color 101B is more away from the white point WP than the input color 101. The display device 10 according to the first embodiment generates the output signals based on the corrected input signals, and displays the image based on the generated output signals so as to display a display color 101C corresponding to the corrected color 101B. Because the display color 101C is a display color corresponding to the corrected color 101B, the display color 101C is more away from the white point WP than the display color 101A that is a display color corresponding to the input color 101. That is, when the display device 10 according to the first embodiment is caused to display the input color 101, the display device 10 can display the display color 101C that is deeper in color (more away from white) than the display color 101A. In the same way, when the display device 10 is caused to display the input color 102, the display device 10 can display a display color 102C that is deeper in color (more away from white) than the display color 102A.

As illustrated in FIG. 11, a distance DI3 between the coordinates of the white point WP and the coordinates of the input color 101 in the XYZ color coordinate system is larger than a distance DI4 between the coordinates of the white point WP and the coordinates of the input color 102 in the XYZ color coordinate system. Due to this, a distance DI5 between the coordinates of the input color 101 and the coordinates of the corrected color 101B in the XYZ color coordinate system is larger than a distance DI6 between the coordinates of the input color 102 and the coordinates of the corrected color 102B in the XYZ color coordinate system. In other words, the display device 10 generates the corrected input signals so that the coordinates of the corrected color in the reference color gamut are more away from the coordinates of the input color in the reference color gamut as the input color is more away from the white point.

As described above, the input color is a color with the coordinates thereof positioned inside the reference color gamut. Accordingly, the input color is a color inside the reference color gamut and outside the display color gamut in some cases, and a color inside the reference color gamut and inside the display color gamut in the other cases. Being outside the display color gamut refers to being in a color gamut in which coordinates more away from the white point than the outer edge of the display color gamut are positioned. Being inside the display color gamut refers to being in a color gamut in which coordinates of the outer edge of the display color gamut and coordinates more close to the white point than the outer edge are positioned. The outer edge of the display color gamut refers to line segments obtained by connecting a plurality of coordinates of display colors farthest from the white point in all directions among display colors that can be expressed by the display device 10. That is, the colors positioned on the outer edge of the display color gamut are colors that are the deepest in color (the most away from white) among those that can be expressed by the display device 10.

In the case of expressing the input color that is a color inside the reference color gamut and outside the display color gamut, the display device 10 sets the corrected color in the following way. The description will be made about the input color 101 as an example. The display color 101C corresponding to the input color 101 is positioned on the outer edge of the display color gamut. When the display device 10 according to the first embodiment is caused to display the input color 101 representing a color inside the reference color gamut and outside the display color gamut, the display device 10 displays the display color 101C that is a color positioned on the outer edge of the display color gamut, as an actually displayed display color. Specifically, the image display panel 40 included in the display device 10 expresses a certain corrected color corresponding to a certain input color as a certain display color expressed inside the display color gamut that is a smaller color gamut than the reference color gamut, and, if the certain input color is a color outside the display color gamut and inside the reference color gamut, the signal processing unit 20 generates the corrected input signals so that the coordinates of the certain display color in the display color gamut are positioned on the outer edge of the display color gamut. In this case, for example, if the coordinates of the input color are positioned on the outer edge of the display color gamut, the display device 10 generates the corrected input signals for representing the corrected color so that the coordinates of the display color expressed corresponding to the corrected color are equal to the coordinates of the input color.

In the case of expressing the input color that is a color inside the reference color gamut and inside the display color gamut, the display device 10 sets the corrected color in the following way. The description will be made about the input color 102 as an example. The display color 102C corresponding to the input color 102 is positioned at the same place as that of the input color 102 in the XYZ color coordinate system. That is, when the display device 10 is caused to express the input color 102 inside the display color gamut, the display device 10 can display the display color 102C that is the same color as the input color 102. That is, if the input color is a color inside the display color gamut, the signal processing unit 20 generates the corrected input signals so that the coordinates of the display color in the display color gamut are equal to the coordinates of the input color. In the display device 10, however, the display color need not be the same color as the input color. In other words, the display device 10 only needs to convert the input signals into the corrected input signals so that the coordinates of the display color come more close to the coordinates of the input color positioned in the display region, and generate the output signals based on the corrected input signals.

When the display device 10 according to the first embodiment is caused to express the input color 112, the display device 10 displays a display color 112C that is the same color as the input color 112 by converting the input color 112 into a corrected input color 112B. In the same way, when the display device 10 is caused to express the input color 113, the display device 10 displays a display color 113C that is the same color as the input color 113 by converting the input color 113 into a corrected input color 113B. Accordingly, the distance in the XYZ color coordinate system between the display color 112C and the display color 113C results in the same as the distance DI1 in the XYZ color coordinate system between the input color 112 and the input color 113. In other words, the display device 10 keeps the distance between the display colors in the display region from decreasing to keep the contrast between the different colors from decreasing.

Figure 12:
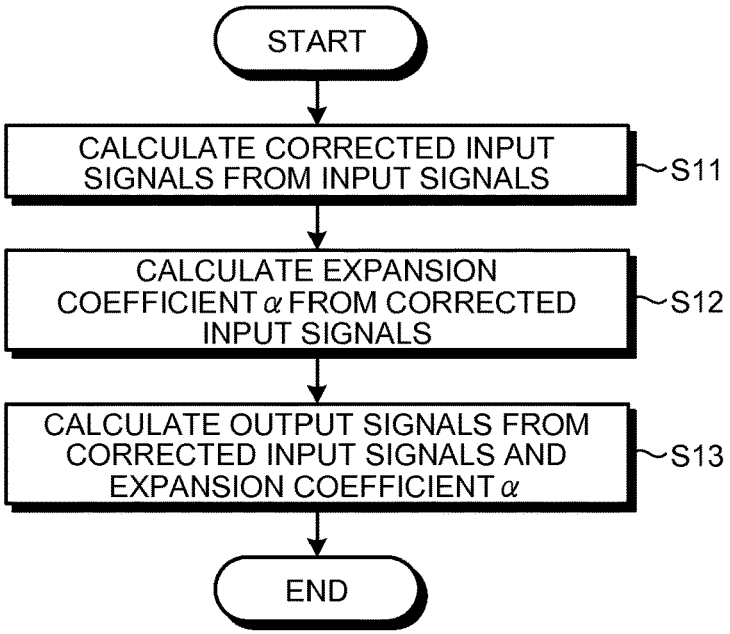
FIG. 12 is a flowchart illustrating a processing procedure of the signal processing unit.

The following describes, based on a flowchart, a procedure of processing the input signals by the signal processing unit 20 according to the first embodiment. FIG. 12 is the flowchart illustrating the processing procedure of the signal processing unit.

As illustrated in FIG. 12, the color conversion unit 23 of the signal processing unit 20 applies the color conversion processing to the input signals to calculate the corrected input signals (Step S11). The signal processing unit 20 generates the corrected input signals so as to correct the input color represented by the input signals into the corrected color positioned in the direction away from the white point. Specifically, the signal processing unit 20 generates the corrected input signal (signal value $xa_{1-(p,q)}$) of the first sub-pixel 49R, the corrected input signal (signal value $xa_{2-(p,q)}$) of the second sub-pixel 49G, and the corrected input signal (signal value $xa_{3-(p,q)}$) of the third sub-pixel 49B, using the expression (1), based on the signal value $x_{1-(p,q)}$ that is the input signal of the first sub-pixel 49R, the signal value $x_{2-(p,q)}$ that is the input signal of the second sub-pixel 49G, and the signal value $x_{3-(p,q)}$ that is the input signal of the third sub-pixel 49B, the signal values being supplied to the (p,q)-th pixel 48.

After generating the corrected input signals, the signal processing unit 20 calculates the expansion coefficient $\alpha$ based on the corrected input signals (Step S12). Specifically, the expansion processing unit 24 of the signal processing unit 20 obtains the saturation S and the brightness V(S) in the pixels 48, through the expressions (6) and (7), based on the signal values of the corrected input signals. Then, the signal processing unit 20 obtains the expansion coefficient $\alpha$, using the expression (10), based on the calculated brightness V(S) and the stored Vmax(S).

After calculating the expansion coefficient $\alpha$, the signal processing unit 20 calculates the output signals based on the corrected input signals and the expansion coefficient $\alpha$, and outputs the results to the image-display-panel driving unit 30 (Step S13). Specifically, the expansion processing unit 24 of the signal processing unit 20 obtains the signal value $X_{4-(p,q)}$ of the output signal for the fourth sub-pixel, using the expression (5) given above, based on $Min_{(p,q)}$, the expansion coefficient $\alpha$, and the constant $\chi$. Then, the signal processing unit 20 obtains the signal value $X_{1-(p,q)}$ of the output signal for the first sub-pixel based on the signal value $xa_{1-(p,q)}$ of the corrected input signal, the expansion coefficient $\alpha$, and the signal value $X_{4-(p,q)}$, obtains the signal value $X_{2-(p,q)}$ of the output signal for the second sub-pixel based on the signal value $xa_{2-(p,q)}$ of the corrected input signal, the expansion coefficient $\alpha$, and the signal value $X_{4-(p,q)}$, and obtains the signal value $X_{3-(p,q)}$ of the output signal for the third sub-pixel based on the signal value $xa_{3-(p,q)}$ of the corrected input signal, the expansion coefficient $\alpha$, and the signal value $X_{4-(p,q)}$. Specifically, the signal processing unit 20 obtains the signal value $X_{1-(p,q)}$, the signal value $X_{2-(p,q)}$, and the signal value $X_{3-(p,q)}$ based on the expressions (2) to (4) given above. With this, the processing by the signal processing unit 20 ends.

As described above, the display device 10 according to the first embodiment converts the input signals into the corrected input signals so as to correct the input color in the reference color gamut into the corrected color positioned in the direction away from the white point, and generates the output signals based on the corrected input signals. As a result, when the display device 10 displays the input color specified by the input signals, the display device 10, for example, keeps the actually displayed display color from becoming paler, and can thus keep the display quality from deteriorating.

The fourth sub-pixel 49W for displaying white is added to the display device 10 according to the first embodiment. As a result, the display device 10 may reduce the contrast of the display color by lighting up the fourth sub-pixel 49W. However, the display device 10 according to the first embodiment can brighten the image by adding the fourth sub-pixel 49W while keeping the contrast of the display color from decreasing because the display device 10 keeps the display color from becoming paler. This feature allows the display device 10 according to the first embodiment to effectively keep the display quality from deteriorating when the fourth sub-pixel is added.

In addition, the display device 10 is a reflective display device. In general, a reflective display device has a smaller display color gamut than that of a transmissive display device. However, in spite of being a reflective display device that has a smaller display color gamut, the display device 10 keeps the display color from becoming paler, and can thereby suitably keep the display quality from deteriorating. In the reflective display device, the light incident from the front of the image display panel passes through the color filters, and the light that has passed through the color filters is reflected on the pixel electrodes, whereby an image is displayed. In the display device 10, although the first to third sub-pixels are provided with color filters, the fourth sub-pixel is provided with no color filter. Hence, the fourth sub-pixel easily passes light. As a result, for example, when only the first sub-pixel is caused to light, the pixel electrode provided in the fourth sub-pixel reflects light, so that white may be mixed in the display color to dilute the display color. However, the display device 10 according to the first embodiment keeps the display color from becoming paler by performing the color conversion processing. As a result, when the fourth sub-pixel is added to the reflective display device, the display device 10 suitably keeps the display color from becoming paler, and can thus keep the display quality from deteriorating.

If the input color is a color outside the display region and inside the reference region, the display device 10 according to the first embodiment generates the corrected input signals so that the coordinates of the display color in the display color gamut are positioned on the outer edge of the display color gamut. In other words, if the input color is a color outside the display region and inside the reference region, the display device 10 keeps the display color as less diluted as possible. As a result, the display device 10 can more suitably keep the display quality from deteriorating. Although the display device 10 preferably process all input colors outside the display region so that display colors corresponding thereto are positioned on the outer edge of the display color gamut, the processing is not limited to this processing. For example, the display device 10 may process some input colors outside the display region so that display colors corresponding thereto are positioned inside the outer edge of the display color gamut.

When the display device 10 according to the first embodiment is caused to express the input color inside the display color gamut, the display device 10 displays the display color that is the same color as the input color. As a result, when the display device 10 is caused to express the input color inside the display color gamut, the display quality is suitably prevented from deteriorating. However, when the display device 10 according to the first embodiment is caused to express the input color inside the display color gamut, the display color need not be the same color as the input color, provided that the display device 10 can keep the display color from becoming paler. The display device 10 keeps the distance between the display colors in the display region from decreasing. As a result, the display device 10 keeps the contrast between colors from decreasing.

2. Modification

The following describes a modification of the first embodiment. A display device 10*a* according to the modification is a reflective display device that is of a front light type and includes light source units 50*a* of a direct type. With respect to the rest of the display device 10*a* according to the modification, the configuration is common to that of the display device 10 according to the first embodiment, so that the description thereof is omitted.

Figure 13:
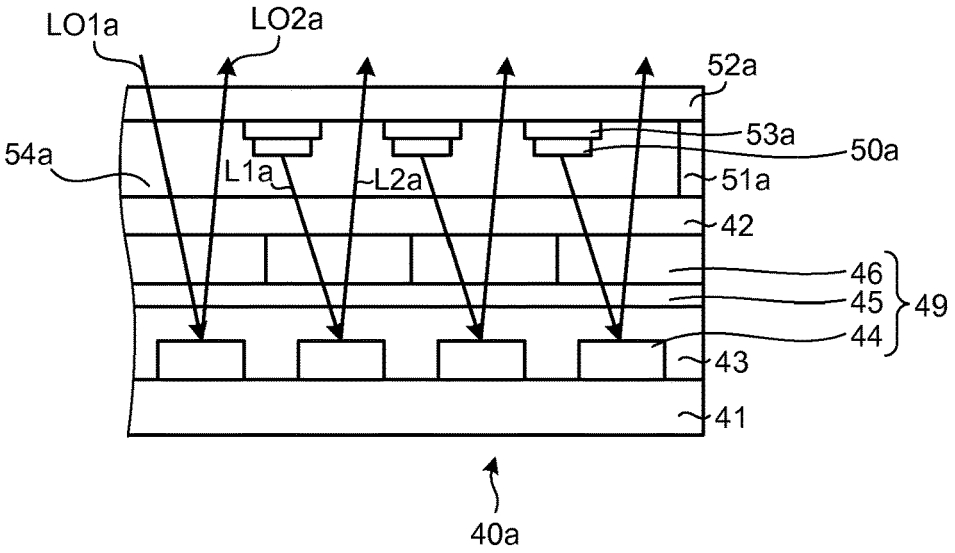
FIG. 13 is a sectional view schematically illustrating a structure of an image display panel according to a modification.

FIG. 13 is a sectional view schematically illustrating a structure of an image display panel according to the modification. As illustrated in FIG. 13, a light source substrate 52*a* is mounted on a surface the counter substrate 42 of an image display panel 40*a* opposite to the liquid crystal layer 43 side, with a support base 51*a* interposed between the surface and the light source substrate 52*a*. The support base 51*a* provides a space 54*a* between the counter substrate 42 and the light source substrate 52*a*.

The light source substrate 52*a* is a transparent substrate, such as a glass substrate. The light source units 50*a* are provided on a surface of the light source substrate 52*a* facing the space 54*a* with a plurality of light-shielding parts 53*a* interposed between the light source units 50*a* and the light source substrate 52*a*. The light-shielding parts 53*a* are light-shielding members of, for example, metal. The light-shielding parts 53*a* keeps light from the light source units 50*a* from directly exiting to the outside through the light source substrate 52*a*. The light-shielding parts 53*a* may be members that have reflective surfaces on which the light source units 50*a* are mounted. The light source units 50*a* are coupled to the signal processing unit 20 through metal wiring or wiring containing a translucent conductive material or the like. In the modification, the light source units 50*a* are LEDs, but may be, for example, organic electroluminescent light sources.

The following describes reflection of light by the image display panel 40*a* according to the modification. As illustrated in FIG. 13, external light LO1*a* is incident on the image display panel 40*a*. The external light LO1*a* is incident on each of the pixel electrodes 44 through the light source substrate 52*a* and the image display panel 40*a*. The external light LO1*a* incident on the pixel electrode 44 is reflected by the pixel electrode 44, and exits, as light LO2*a*, to the outside through the image display panel 40*a* and the light source substrate 52*a*. When the light source units 50*a* are on, light L1*a* from each of the light source units 50*a* is incident on the image display panel 40*a* from the counter substrate 42 side of the image display panel 40*a*, and is projected on the pixel electrode 44. The light L1*a* projected on the pixel electrode 44 is reflected by the pixel electrode 44, and exits, as light L2*a*, to the outside through the image display panel 40*a* and the light source substrate 52*a*.

In other words, the pixel electrodes 44 reflect the external light LO1*a* and/or the light L1*a* toward the outside, the external light LO1*a* being incident on the image display panel 40*a* from the front surface thereof that is a surface on the external side (the counter substrate 42 side) of the image display panel 40*a*. The light LO2*a* and the light L2*a* reflected toward the outside pass through the liquid crystal layer 43 and the color filters 46. Due to this, the display device 10*a* can display an image with the light LO2*a* and the light L2*a*. As described above, the display device 10*a* according to the modification is a reflective display device that is of a front light type and includes the light source units 50*a* of a direct type. Also with the configuration as described above, by performing the color conversion processing, the display device 10*a* according to the modification can keep the display quality from deteriorating while brightening the image on the reflective display device that tends to display images darkly.

3. Second Embodiment

The following describes a second embodiment. A display device 10*b* according to the second embodiment is a transmissive display device that includes a planar light source device provided on the back side of an image display panel opposite to the display surface thereof for displaying images. With respect to the rest of the display device 10*b* according to the second embodiment, the configuration is common to that of the display device 10 according to the first embodiment, so that the description thereof is omitted.

Figure 14:
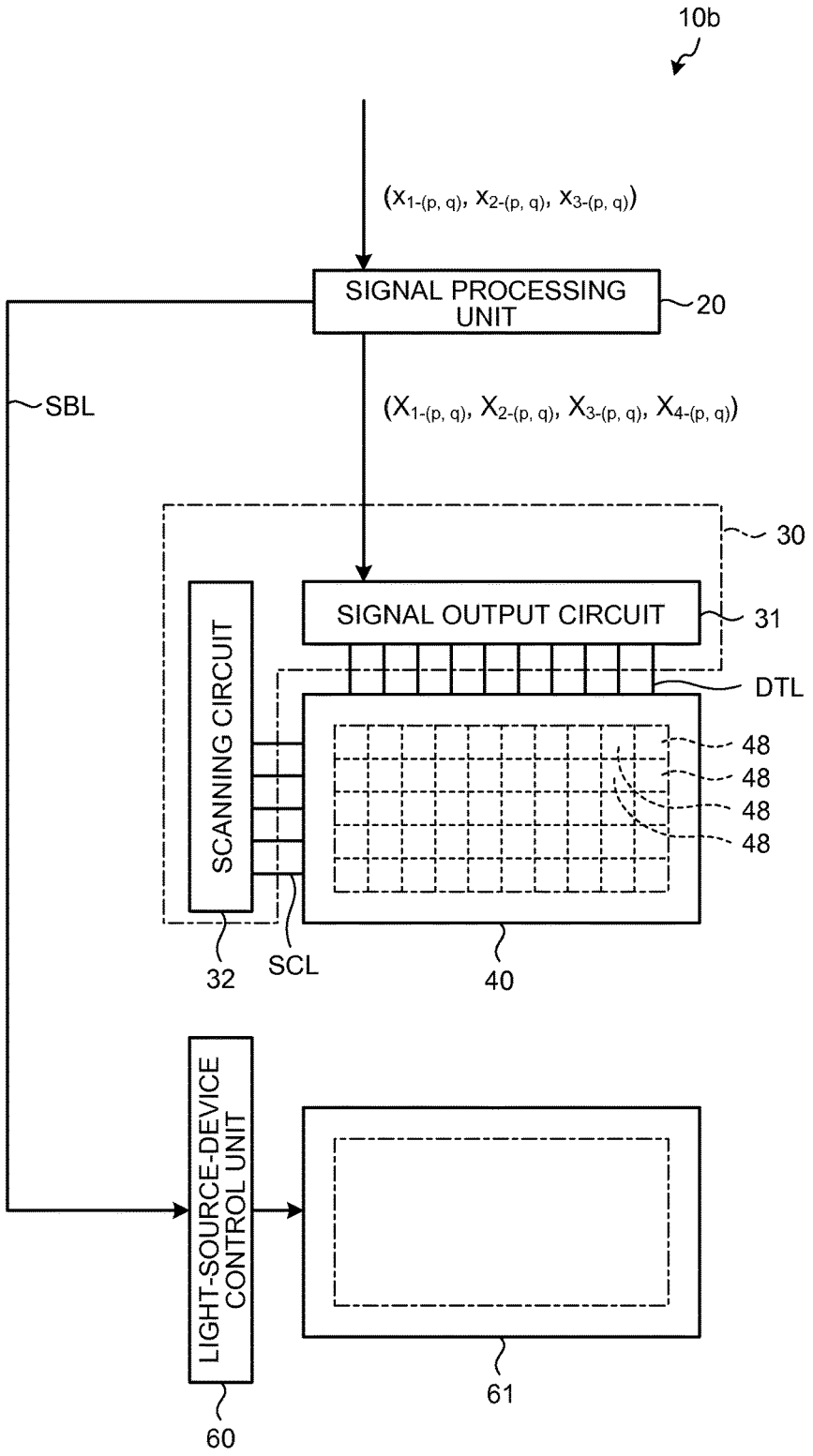
FIG. 14 is a block diagram illustrating an example of the configuration of a display device according to a second embodiment of the present invention.

FIG. 14 is a block diagram illustrating an example of the configuration of the display device according to the second embodiment. As illustrated in FIG. 14, the display device 10*b* according to the second embodiment includes the signal processing unit 20, the image-display-panel driving unit 30, the image display panel 40, a light-source-device control unit 60, and a light source device 61. In the display device 10*b*, the signal processing unit 20 sends signals to components of the display device 10*b*; the image-display-panel driving unit 30 controls driving of the image display panel 40 based on signals received from the signal processing unit 20; the image display panel 40 causes an image to be displayed based on the signals received from the image-display-panel driving unit 30; the light-source-device control unit 60 controls driving of the light source device 61 based on a signal from the signal processing unit 20; and the light source device 61 illuminates the image display panel 40 from the back side thereof based on a signal of the light-source-device control unit 60 to display the image.

The light source device 61 is provided on the back of the image display panel 40, and is controlled by the light-source-device control unit 60 to emit light toward the image display panel 40, thereby illuminating the image display panel 40 and causing the image to be displayed thereon. The light source device 61 irradiates the image display panel 40 with the light to brighten the image display panel 40.

The light-source-device control unit 60 controls, for example, the quantity of light output from the light source device 61. Specifically, the light-source-device control unit 60 controls the quantity of light (intensity of light) for irradiating the image display panel 40 by adjusting, for example, the voltage supplied to the light source device 61 using, for example, pulse width modulation (PWM) based on a light source device control signal SBL output from the signal processing unit 20.

The display device 10*b* performs the same color conversion processing as that of the display device 10 according to the first embodiment to generate the corrected input signals from the input signals. The display device 10*b* performs the same expansion processing as that of the display device 10 according to the first embodiment to calculate the expansion coefficient cc from the corrected input signals, and outputs the output signals based on the corrected input signals and the expansion coefficient $\alpha$.

In the display device 10*b*, the output signal value $X_{1-(p,q)}$, the output signal value $X_{2-(p,q)}$, and the output signal value $X_{3-(p,g)}$ for the (p,q)-th pixel are expanded by $\alpha$ times. The display device 10*b* may reduce the luminance of the light source device 61 based on the expansion coefficient $\alpha$ so as to cause the luminance to be the same as that of the image the output signal values of which are not expanded. Specifically, the display device 10*b* reduces the luminance of the light source device 61 by a factor of $(1/\alpha)$. With this reduction in the luminance, the display device 10*b* can reduce the power consumption of the light source device 61. The signal processing unit 20 outputs this value $(1/\alpha)$ as the light source device control signal SBL to the light-source-device control unit 60 (refer to FIG. 14).

Because the display device 10*b* according to the second embodiment is a transmissive display device, the display color gamut of the display device 10*b* is generally larger than the display color gamut of the display device 10. However, the display color gamut of the display device 10*b* is narrowed by the fourth sub-pixel 49W, or has a shape different from that of the reference color gamut. Hence, performing the same color conversion processing as that of the first embodiment can keep the display quality from deteriorating, in the same way as in the case of the first embodiment.

Figure 15:
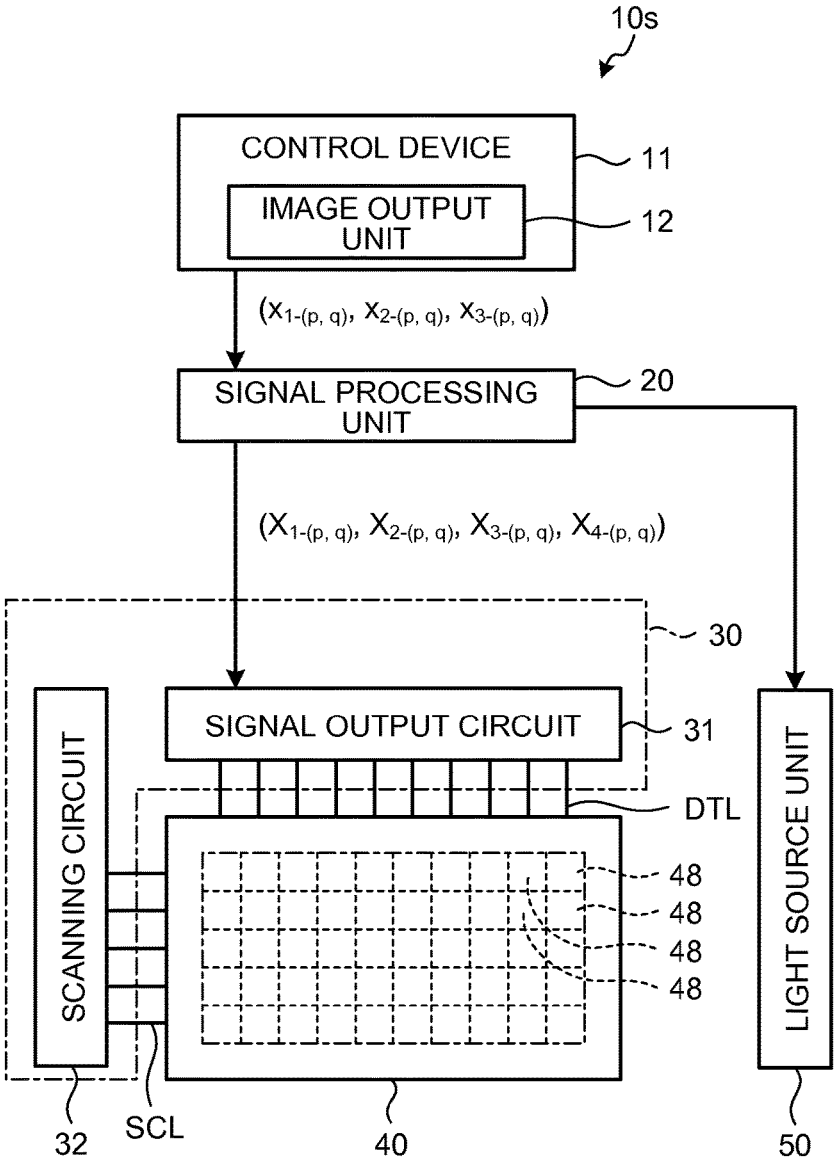
FIG. 15 is a block diagram illustrating another example of the configuration of the display device according to the first embodiment.
Figure 16:
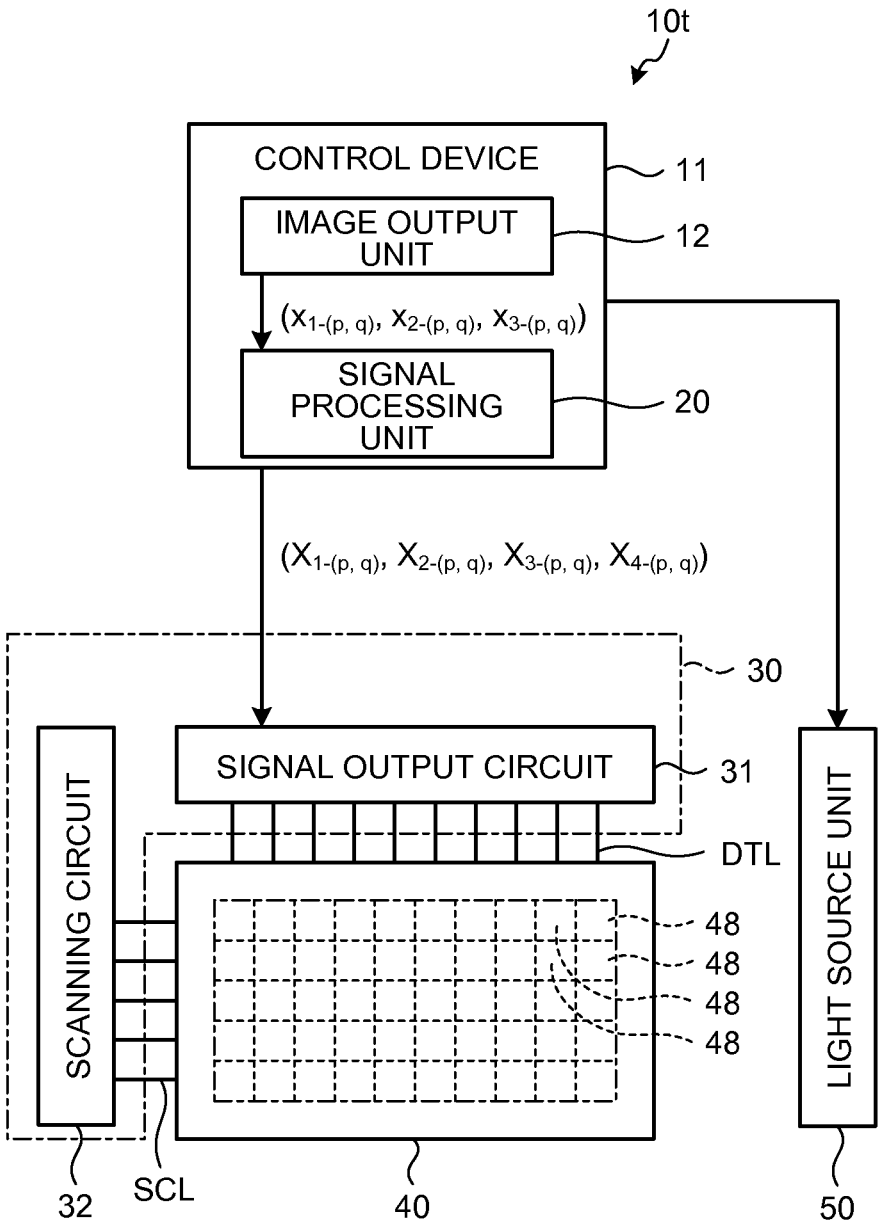
FIG. 16 is a block diagram illustrating still another example of the configuration of the display device according to the first embodiment.

FIGS. 15 and 16 are block diagrams illustrating other examples of the configuration of the display device according to the first embodiment. In a display device 10*s* according to another example illustrated in FIG. 15 includes a control device 11 that outputs the input signals to the signal processing unit 20. The control device 11 includes an image output unit 12, and the image output unit 12 outputs the input signals to the signal processing unit 20. In a display device 10*t* according to still another example illustrated in FIG. 16, the signal processing unit 20 is a part of the control device 11. When the signal processing unit 20 is a part of the control device 11, the signal processing unit 20 can process the input signals by only performing the processing in the control device 11.

4. Third Embodiment

The following describes a third embodiment. A display device 10*c* according to the third embodiment differs from the display device 10 according to the first embodiment in that a signal processing unit 20*c* applies the expansion processing to the input signals to generate output signals, and thereafter, the signal processing unit 20*c* applies the color conversion processing to the output signals. With respect to the rest of the display device 10*c* according to the third embodiment, the configuration is common to that of the display device 10 according to the first embodiment, so that the description thereof is omitted.

Figure 17:
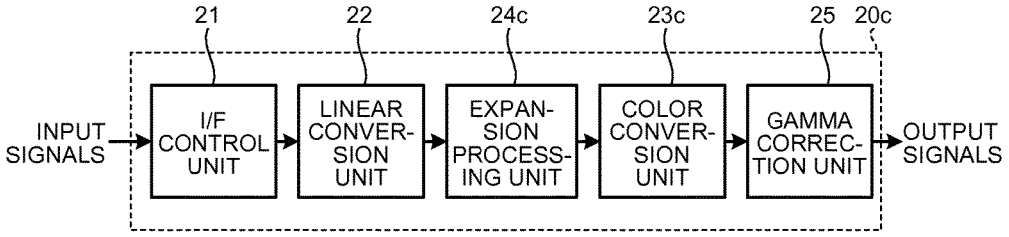
FIG. 17 is a block diagram illustrating the configuration of a signal processing unit according to a third embodiment of the present invention.

FIG. 17 is a block diagram illustrating the configuration of the signal processing unit according to the third embodiment. As illustrated in FIG. 17, the signal processing unit 20*c* according to the third embodiment includes the I/F control unit 21, the linear conversion unit 22, an expansion processing unit 24*c*, a color conversion unit 23*c*, and the gamma correction unit 25.

The expansion processing unit 24*c* is coupled to the linear conversion unit 22. The expansion processing unit 24*c* receives the input signals from the linear conversion unit 22, and performs the expansion processing based on the received signals to generate output signals that include data of a white (W) component for driving the fourth sub-pixel 49W in the pixel 48. That is, unlike the expansion processing unit 24 according to the first embodiment, the expansion processing unit 24*c* directly applies the expansion processing to the input signals not having been color-converted. The expansion processing performed by the expansion processing unit 24*c* is the same processing as the expansion processing according to the first embodiment, except that the expansion processing unit 24*c* applies the expansion processing to the input signals.

The color conversion unit 23*c* is coupled to the expansion processing unit 24*c*. The color conversion unit 23*c* receives the output signals generated by the expansion processing unit 24*c*. The color conversion unit 23*c* applies the color conversion processing to the received output signals to generate corrected output signals. The color conversion unit 23*c* is coupled to the gamma correction unit 25. The color conversion unit 23*c* outputs the corrected output signals to the gamma correction unit 25. The display device 10*c* displays the image based on the corrected output signals. In this way, unlike the color conversion unit 23 according to the first embodiment, the color conversion unit 23*c* applies the color conversion processing to the output signals after being expanded to generate the corrected output signals. The color conversion processing performed by the color conversion unit 23*c* is the same processing as the color conversion processing according to the first embodiment, except that the color conversion unit 23*c* applies the color conversion processing to the output signals.

Figure 18:
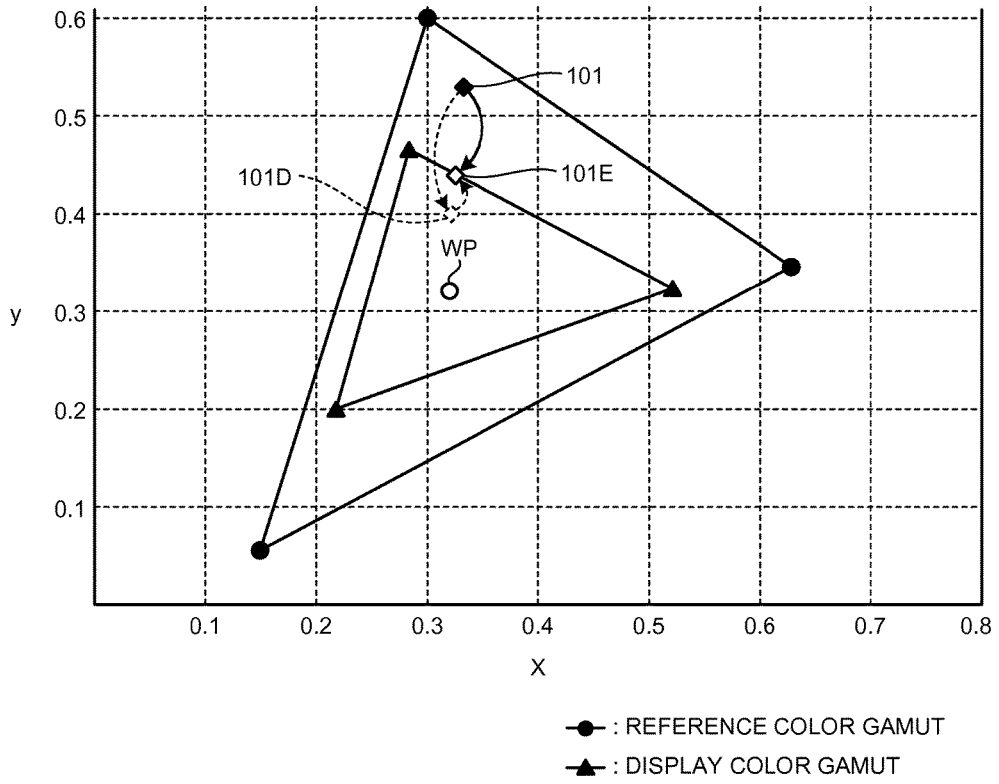
FIG. 18 is a schematic diagram illustrating an example of display colors expressed by a display device according to the third embodiment.

FIG. 18 is a schematic diagram illustrating an example of display colors expressed by the display device according to the third embodiment. As described above, the signal processing unit 20*c* according to the third embodiment applies the color conversion processing to the output signals after being expanded. The following describes display of a display color by using the color conversion processing performed by the signal processing unit 20*c* according to the third embodiment, by way of an example of the input color 101, as illustrated in FIG. 18.

The signal processing unit 20*c* generates output signals by expanding the input signals corresponding to the input color 101 without applying the color conversion thereto. Specifically, in FIG. 18, a virtual display color 101D is a color assumed to be displayed if the image display panel 40 displays an image based on the output signals, and is a color that has the same coordinates as those of the display color 101A according to the comparative example (refer to FIG. 11) because of not having been subjected to the color conversion processing. The virtual display color 101D is not a color actually displayed by the display device 10*c* because the signal processing unit 20*c* actually displays a color obtained after the color conversion processing is applied to the output signals.

The signal processing unit 20*c* applies the color conversion processing to the output signals to generate corrected output signals. The display device 10*c* displays the image based on the corrected output signals. Specifically, the display device 10*c* displays a display color 101E that is a color corresponding to the corrected output signals. The display color 101E is a color that has the same coordinates as those of the display color 101C according to the first embodiment (refer to FIG. 11) because of having been subjected to the same color conversion processing as that of the first embodiment.

More specifically, the signal processing unit 20*c* according to the third embodiment generates the corrected output signals from the output signals so that the display color 101E is positioned in a direction more away from the white point WP than the virtual display color 101D that is a color assumed to be displayed corresponding to the output signals not having been subjected to the color conversion processing. As a result, in the present embodiment, the input color 101 positioned at the XY coordinates inside the reference color gamut and outside the display color gamut is output as the display color 101E positioned on the outer edge of the display color gamut. As a result, when the display device 10*c* displays the input color specified by the input signals, the display device 10*c*, for example, keeps the actually displayed display color from becoming paler, and can thus keep the display quality from deteriorating, in the same way as the display device 10 according to the first embodiment.

The signal processing unit 20*c* according to the third embodiment may generate the corrected output signals so that the coordinates of the display color are more away from the coordinates of the virtual display color as the virtual display color is more away from the white point. The signal processing unit 20*c* according to the third embodiment may generate the corrected output signals so that the coordinates of the display color in the display color gamut are positioned on the outer edge of the display color gamut if the input color is a color outside the display color gamut and inside the reference color gamut. The signal processing unit 20*c* according to the third embodiment may display a display color that is the same color as the input color if the input color is a color inside the display color gamut. However, when the signal processing unit 20*c* is caused to express the input color inside the display color gamut, the display color need not be the same color as the input color, provided that the signal processing unit 20*c* can keep the display color from becoming paler.

Figure 19:
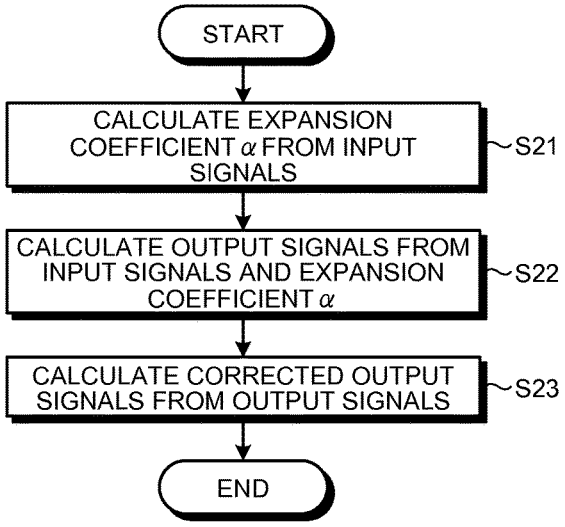
FIG. 19 is a flowchart illustrating a processing procedure of the signal processing unit.

The following describes, based on a flowchart, a procedure of processing the input signals by the signal processing unit 20*c* according to the third embodiment. FIG. 19 is the flowchart illustrating the processing procedure of the signal processing unit.

As illustrated in FIG. 19, the signal processing unit 20*c* calculates the expansion coefficient $\alpha$ based on the input signals (Step S21). Specifically, the signal processing unit 20*c* replaces the corrected input signals for the expressions (6) and (7) with the input signals and obtains the saturation S and the brightness V(S) of the pixels 48 in the expansion processing unit 24*c* based on the signal values of the input signals. Then, the signal processing unit 20*c* obtains the expansion coefficient $\alpha$, using the expression (10), based on the calculated brightness V(S) and the stored Vmax(S).

After calculating the expansion coefficient $\alpha$, the signal processing unit 20*c* calculates the output signals based on the input signals and the expansion coefficient $\alpha$(Step S22). Specifically, the expansion processing unit 24*c* of the signal processing unit 20*c* obtains the signal value $X_{4-(p,q)}$ of the output signal for the fourth sub-pixel by replacing the corrected input signals for the expression (5) given above with the input signals. Then, the signal processing unit 20*c* obtains the signal value $X_{1-(p,q)}$ of the output signal for the first sub-pixel, the signal value $X_{2-(p,q)}$ of the output signal for the second sub-pixel, and the signal value $X_{3-(p,q)}$ of the output signal for the third sub-pixel by replacing the corrected input signals in the expressions (2) to (4) given above with the input signals.

After the output signals for the sub-pixels are obtained, the color conversion unit 23*c* of the signal processing unit 20*c* applies the color conversion processing to the output signals to calculate the corrected output signals (Step S23). The signal processing unit 20*c* generates the corrected output signals from the output signals so that the display color actually displayed by the display device 10*c* is positioned in a direction more away from the white point than the virtual display color that is a color assumed to be displayed corresponding to the output signals not having been subjected to the color conversion processing. Specifically, the signal processing unit 20*c* calculates the corrected output signals by replacing the input signals ($x_{1-(p,q)}$, $x_{2-(p,q)}$, and $x_{3-(p,q)}$) with the output signals ($X_{1-(p,q)}$, $X_{2-(p,q)}$, and $X_{3-(p,q)}$) in the expression (1) given above, and outputs the results to the image-display-panel driving unit 30. With this, the processing by the signal processing unit 20*c* ends.

In this way, the display device 10*c* according to the third embodiment expands the input signals to generate the output signals, applies the color conversion processing to the generated output signals to generate the corrected output signals, and displays the image based on the corrected output signals. In other words, the signal processing unit 20*c* of the display device 10*c* determines the expansion coefficient α related to the image display panel 40, and obtains the output signal for the first sub-pixel 49R, the output signal for the second sub-pixel 49G, the output signal for the third sub-pixel 49B, and the output signal for the fourth sub-pixel 49W. The output signal for the first sub-pixel 49R is obtained based on at least the input signal of the first sub-pixel 49R and the expansion coefficient α. The output signal for the second sub-pixel 49G is obtained based on at least the input signal of the second sub-pixel 49G and the expansion coefficient α. The output signal for the third sub-pixel 49B is obtained based on at least the input signal of the third sub-pixel 49B and the expansion coefficient α. The output signal for the fourth sub-pixel 49W is obtained based on the input signal of the first sub-pixel 49R, the input signal of the second sub-pixel 49G, the input signal of the third sub-pixel 49B and the expansion coefficient α. The output signal for the first sub-pixel 49R, the output signal for the second sub-pixel 49G, the output signal for the third sub-pixel 49B, and the output signal for the fourth sub-pixel 49W are corrected into the output values of the corrected output signals before being output to the first, the second, the third, and the fourth sub-pixels 49R, 49G, 49B, and 49W. The output values of the output signal for the first sub-pixel 49R, the output signal for the second sub-pixel 49G, the output signal for the third sub-pixel 49B, and the output signal for the fourth sub-pixel 49W represent the virtual display color that is a color assumed to be displayed if the image display panel 40 displays the image. The output values of the corrected output signals are output after being corrected so that the above-mentioned virtual display color serves as color information of a display color positioned in a direction away from the white point that is a place where white is represented in the reference color gamut or the display color gamut that is a color gamut of colors displayable by the image display panel. The first, the second, the third, and the fourth sub-pixels 49R, 49G, 49B, and 49W each display the output values of the corrected output signals of the output signal for the first sub-pixel 49R, the output signal for the second sub-pixel 49G, the output signal for the third sub-pixel 49B, and the output signal for the fourth sub-pixel 49W, respectively.

The color conversion processing according to the third embodiment is the same processing as the color conversion processing according to the first embodiment, except that the color conversion processing according to the third embodiment is applied to the output signals. Due to this, the display device 10*c* according to the third embodiment can keep the display quality from deteriorating, in the same way as the display device 10 according to the first embodiment.

5. Application Examples

Figure 20:
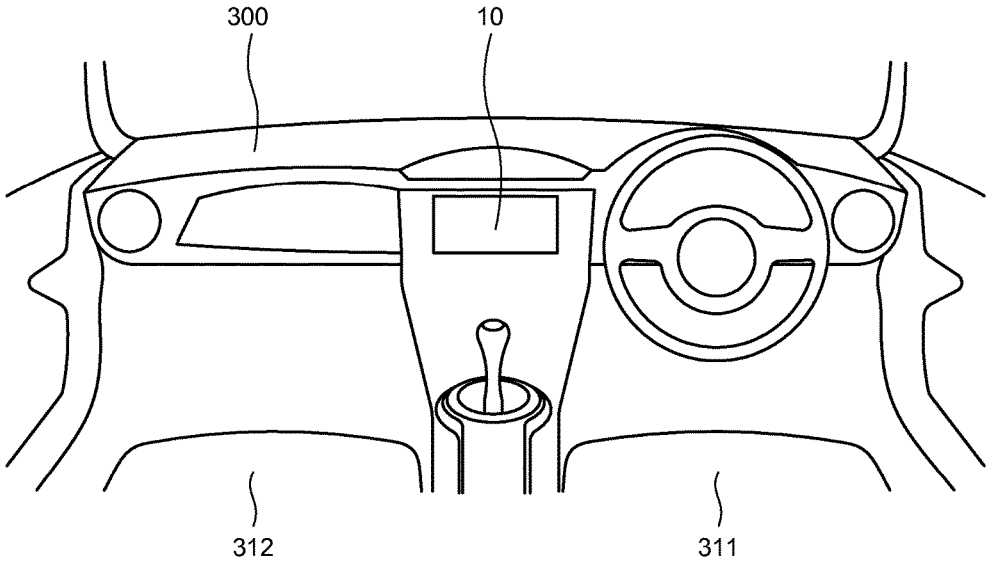
FIG. 20 is a diagram illustrating an example of an electronic apparatus to which the display device according to the first embodiment is applied.
Figure 21:
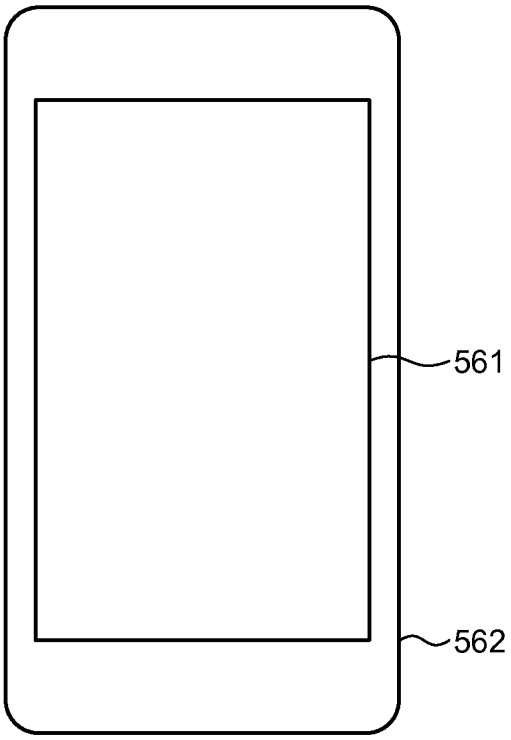
FIG. 21 is a diagram illustrating another example of the electronic apparatus to which the display device according to the first embodiment is applied.

The following describes application examples of the display device 10 described in the first embodiment with reference to FIGS. 20 and 21. FIGS. 20 and 21 are diagrams illustrating examples of an electronic apparatus to which the display device according to the first embodiment is applied. The display device 10 according to the first embodiment can be applied to electronic apparatuses in various fields, such as automotive navigation systems such as one illustrated in FIG. 20, television devices, digital cameras, laptop computers, portable electronic apparatuses including mobile phones such as one illustrated in FIG. 21, and video cameras. In other words, the display device 10 according to the first embodiment can be applied to electronic apparatuses in various fields that display externally received video signals or internally generated video signals as images or videos. Each of such electronic apparatuses includes the control device 11 (refer to FIG. 15) that supplies video signals to the display device and controls operations of the display device. The application examples given here can be applied to, in addition to the display device 10 according to the first embodiment, the display devices according to the other embodiments, the modification, and the other examples described above.

The electronic apparatus illustrated in FIG. 20 is an automotive navigation device to which the display device 10 according to the first embodiment is applied. The display device 10 is installed on a dashboard 300 in the interior of an automobile. Specifically, the display device 10 is installed between a driver seat 311 and a passenger seat 312 on the dashboard 300. The display device 10 of the automotive navigation device is used for navigation display, display of an audio control screen, reproduction display of a movie, or the like.

The electronic apparatus illustrated in FIG. 21 is a portable information apparatus to which the display device 10 according to the first embodiment is applied. The portable information apparatus operates as a portable computer, a multifunctional mobile phone, a mobile computer allowing a voice communication, or a communicable portable computer, and is sometimes called a smartphone or a tablet terminal. The portable information apparatus includes, for example, a display unit 561 on a surface of a housing 562. The display unit 561 includes the display device 10 according to the first embodiment, and has a touch detection (what is called a touch panel) function that enables detection of an external proximity object.

While the embodiments and the modification of the present invention have been described above, the embodiments and the like are not limited to the contents thereof. The components described above include components easily conceivable by those skilled in the art, substantially the same components, and components in the range of what are called equivalents. The components described above can also be appropriately combined with each other. In addition, the components can be variously omitted, replaced, or modified without departing from the gist of the embodiments and the like described above. For example, the pixels included in the display device according to the present invention may be arranged in a diagonal array.

Figure 22:
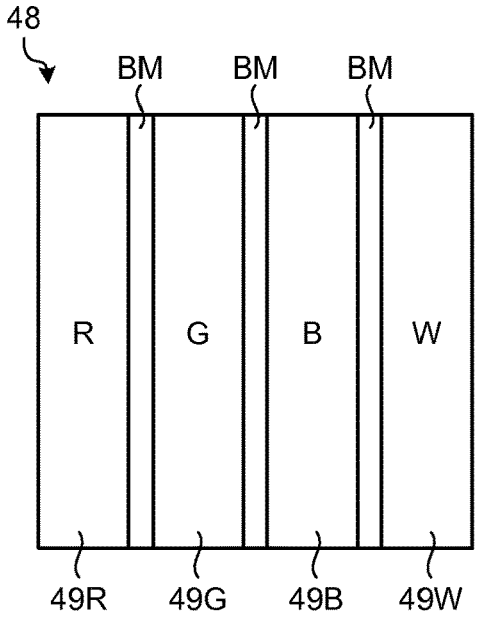
FIG. 22 is a schematic diagram illustrating the configuration of a pixel according to the first embodiment.
Figure 23:
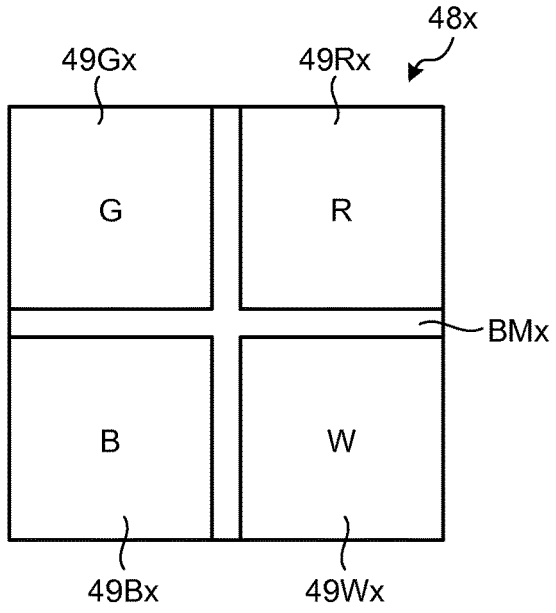
FIG. 23 is a schematic diagram illustrating the configuration of a pixel according to another example of the present disclosure.

FIG. 22 is a schematic diagram illustrating the configuration of the pixel according to the first embodiment. FIG. 23 is a schematic diagram illustrating the configuration of a pixel according to another example. As illustrated in FIG. 22, the pixel 48 according to the first embodiment has, for example, a square shape, in which the first, the second, the third, and the fourth sub-pixels 49R, 49G, 49B, and 49W are arranged in a stripe array. A black matrix BM for shielding light is provided between adjacent sub-pixels. Compared with this, as illustrated in FIG. 23, a pixel 48*x* according to the other example of the present invention has the same square shape as that of the pixel 48, and a first sub-pixel 49Rx, a second sub-pixel 49Gx, a third sub-pixel 49Bx, and a fourth sub-pixel 49Wx form a diagonal array in the pixel 48*x*. A black matrix BMx for shielding light is provided between adjacent sub-pixels in the pixel 48*x*. A display device according to this aspect may include pixels having a structure of the pixel 48$x$. As illustrated in FIG. 22, the black matrix BM included in the stripe-arrayed pixel 48 is arranged in a total of three lines, one between the first sub-pixel 49R and the second sub-pixel 49G, another between the second sub-pixel 49G and the third sub-pixel 49B, and the third one between third sub-pixel 49B and the fourth sub-pixel 49W. Compared with this, as illustrated in FIG. 23, the black matrix BMx included in the diagonal-arrayed pixel 48$x$ consists of two orthogonal lines, one being provided between a set of the first sub-pixel 49R and the second sub-pixel 49G and a set of the third sub-pixel 49B and the fourth sub-pixel 49W, and the other being orthogonal thereto and being provided between a set of the second sub-pixel 49G and the third sub-pixel 49B and a set of the first sub-pixel 49R and the fourth sub-pixel 49W. Therefore, if the widths of the lines of the black matrices BM and BMx are equal to each other, the black matrix BMx included in the diagonal-arrayed pixel 48$x$ has a smaller area than that of the black matrix BM included in the stripe-arrayed pixel 48, and is capable of suppressing reduction in aperture ratio.

The display device 10 may include, for example, a self-luminous image display panel in which self-luminous bodies such as organic light-emitting diodes (OLEDs) are lit.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A display device comprising:

an image display panel in which pixels are arranged in a two-dimensional matrix, each of the pixels including a first sub-pixel that displays a first color, a second sub-pixel that displays a second color, a third sub-pixel that displays a third color, and a fourth sub-pixel that displays a fourth color, wherein the first color, the second color and the third color form a displayable color gamut and the displayable color gamut has a white point; and a signal processing unit that converts an input signal, including a first input signal, a second input signal and a third input signal, into an output signal including, a first output signal for the first sub-pixel, a second output signal for the second sub-pixel, a third output signal for the third sub-pixel and a fourth output signal for the fourth sub-pixel, wherein the first input signal has a first color information value, the second input signal has a second color information value and the third input signal has a third color information value, wherein the signal processing unit is configured to;

correct the first input value into a corrected first input value, correct the second input value into a corrected second input value, and correct the third input value into a corrected third input value;

determine an expansion coefficient after correcting the first input signal, second input signal and third input signal into the first corrected input signal, second corrected input signal, and the third corrected input signal;

obtain the first output signal and the second output signal and the third output signal based on the expansion coefficient, wherein the signal processing unit includes a color conversion unit and an expansion processing unit, wherein the color conversion unit is configured to:

correct the first input signal into the corrected first input signal having a corrected first color information value by positioning the first color information value in a direction away from the white point in the displayable color gamut, correct the second input signal into the corrected second input signal having a corrected second color information value by positioning the second color information value in a direction away from the white point in the displayable color gamut, and correct the third input signal into the corrected third input signal having a corrected third color information value by positioning the third color information value in a direction away from the white point in the displayable color gamut, and wherein the expansion processing unit is configured to:

determine the expansion coefficient related to the image display panel based on the corrected first input signal, the corrected second input signal and the corrected third input signal, obtain the first output signal for the first sub-pixel based on the corrected first input signal and the expansion coefficient, and output the first output signal to the first sub-pixel, obtain the second output signal for the second sub-pixel based on the corrected second input signal and the expansion coefficient, and output the second output signal to the second sub-pixel, obtain the third output signal for the third sub-pixel based on the corrected third input signal and the expansion coefficient, and output the third output signal to the third sub-pixel, and obtain the fourth output signal for the fourth sub-pixel based on the corrected first, second, and third input signals and the expansion coefficient, and output the fourth output signal to the fourth sub-pixel;

$$\begin{pmatrix} Xa_{1-(p,q)} \\ Xa_{2-(p,q)} \\ Xa_{3-(p,q)} \end{pmatrix} = \begin{pmatrix} RR & GR & BR \\ RG & GG & BG \\ RB & GB & BB \end{pmatrix} \times \begin{pmatrix} X_{1-(p,q)} \\ X_{2-(p,q)} \\ X_{3-(p,q)} \end{pmatrix}. \quad (1)$$

2. The display device according to claim 1, wherein the first sub-pixel, the second sub-pixel, the third sub-pixel, and the fourth sub-pixel each include a reflector that reflects light incident thereon from a front surface of the image display panel so as to display an image with the light reflected by the reflector.

3. The display device according to claim 1, further comprising a light source unit that is provided on a front side of the image display panel opposite to the display surface thereof on which an image is displayed, and that irradiates the image display panel with light based on a light source control signal from the signal processing unit to display the image with the light from the light source.

4. The display device according to claim 1, wherein the fourth color is white.

5. The display device according to claim 1, wherein when a distance between the second color information value and the white point is greater than a distance between the first color information value and the white point, a distance between the corrected second color information value and the white point is greater than a distance between the corrected first color information value and the white point.

6. An electronic apparatus comprising:

the display device according to claim 1; and a control device that supplies input signals to the display device.

7. A method for driving a display device, the display device comprising an image display panel including a plurality of pixels each including a first sub-pixel that displays a first color, a second sub-pixel that displays a second color, a third sub-pixel that displays a third color, and a fourth sub-pixel that displays a fourth color, wherein the first color, the second color and the third color form a displayable color gamut and the displayable color gamut having a white point, the method comprising:

obtaining an output signal including a first output signal for the first sub-pixel, a second output signal for the second sub-pixel, a third output signal for the third sub-pixel and a fourth output signal for the fourth sub-pixel; and controlling an operation of the first sub-pixel, the second sub-pixel, the third sub-pixel, and the fourth sub-pixel based on the first, second, third and fourth output signals, wherein obtaining of the first, second, third and fourth output signals includes:

correcting a first input value into a corrected first input value, correct the second input value into a corrected second input value, and correct the third input value into a corrected third input value;

determining an expansion coefficient after correcting the first input signal, second input signal and third input signal into the first corrected input signal, second corrected input signal, and the third corrected input signal; and obtaining the first output signal and the second output signal and the third output signal based on the expansion coefficient, correcting the first input signal having a first color information value into a corrected first input signal having a corrected first color information value by positioning the first color information value in a direction away from the white point in the displayable color gamut, correcting the second input signal having a second color information value into a corrected second input signal having a corrected second color information value by positioning the first color information value in a direction away from the white point in the displayable color gamut, correcting the third input signal having a third color information value into a corrected third input signal having a corrected third color information value by positioning the first color information value in a direction away from the white point in the displayable color gamut, determining the expansion coefficient related to the image display panel based on the corrected first input signal, the corrected second input signal and the corrected third input signal, obtaining the first output signal for the first sub-pixel based on the corrected first input signal and the expansion coefficient, obtaining the second output signal for the second sub-pixel based on the corrected second input signal and the expansion coefficient, obtaining the third output signal for the third sub-pixel based on the corrected third input signal and the expansion coefficient, and obtaining the fourth output signal for the fourth sub-pixel based on the corrected first, second, and third input signals and the expansion coefficient;

$$\begin{pmatrix} Xa_{1-(p,q)} \\ Xa_{2-(p,q)} \\ Xa_{3-(p,q)} \end{pmatrix} = \begin{pmatrix} RR & GR & BR \\ RG & GG & BG \\ RB & GB & BB \end{pmatrix} \times \begin{pmatrix} X_{1-(p,q)} \\ X_{2-(p,q)} \\ X_{3-(p,q)} \end{pmatrix}. \quad (1)$$

* * * * *